US006384542B2

(12) United States Patent
Tsukamoto

(10) Patent No.: US 6,384,542 B2
(45) Date of Patent: May 7, 2002

(54) ELECTRON-EMITTING APPARATUS AND IMAGE-FORMING APPARATUS

(75) Inventor: Takeo Tsukamoto, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/731,744

(22) Filed: Dec. 8, 2000

(30) Foreign Application Priority Data

Dec. 8, 1999 (JP) ..... 11-349421
Dec. 4, 2000 (JP) ..... 2000-369010

(51) Int. Cl.[7] ..... G09G 3/10
(52) U.S. Cl. ..... 315/169.3; 315/160; 345/76
(58) Field of Search ..... 315/169.3, 167, 315/169.1, 160; 345/45, 47, 65, 73, 74, 75, 76

(56) References Cited

U.S. PATENT DOCUMENTS

| | | | | |
|---|---|---|---|---|
| 5,066,883 A | | 11/1991 | Yoshioka et al. | 313/309 |
| 5,872,541 A | * | 2/1999 | Yoshioka et al. | 345/74.1 |
| 5,912,531 A | | 6/1999 | Hasegawa et al. | 313/495 |
| 6,005,540 A | * | 12/1999 | Shinjo et al. | 313/309 |
| 6,121,942 A | * | 9/2000 | Sanou et al. | 313/495 |
| 6,144,350 A | * | 11/2000 | Fujii et al. | 345/55 |

FOREIGN PATENT DOCUMENTS

| | | |
|---|---|---|
| EP | 0 660 357 A1 | 6/1995 |
| EP | 0 701 265 A1 | 3/1996 |
| EP | 0 716 439 A1 | 6/1996 |
| JP | 1-105445 | 4/1989 |
| JP | 4-137328 A | 5/1992 |
| JP | 9-265897 A | 10/1997 |
| JP | 10-055745 A | 2/1998 |

OTHER PUBLICATIONS

M. Okuda, et al., "Electron Trajectory Analysis of Surface Conduction Electron Emitter displays (SEDs)", SID 98 DIGEST, p. 185–188.

* cited by examiner

*Primary Examiner*—Don Wong
*Assistant Examiner*—Thuy Vinh Tran
(74) *Attorney, Agent, or Firm*—Fitzpatrick, Cella, Harper & Scinto

(57) ABSTRACT

An electron-emitting apparatus comprising a substrate, an electron-emitting device comprising a layer structure having a first electroconductive member provided on the surface of the substrate, an insulation layer provided on the first electroconductive member, and a second electroconductive member provided on the insulation layer, an anode electrode provided apart from the surface of the substrate, first voltage application means for applying potential, higher than the potential applied to the first electroconductive member, to the second electroconductive member, and second voltage application means for applying potential, higher than the potential applied to the second electroconductive member, to the anode electrode, wherein $$T1 < A \times \exp\left[B \times (Vf - \phi wk)/(Vf)\right]$$

$$A = -0.50 + 0.56 \times \log(T3),\ B = 8.7$$

where:

on the end plane of the insulation layer placed substantially parallel to the surface of the substrate, the end portion of the first electroconductive member and the end portion of the second electroconductive member are set opposite each other with a space between, in a direction of the end portion of the first electroconductive member and the end portion of the second electroconductive member set opposite each other, the second electroconductive film is T1 [nm] long, the first electroconductive member extending from the surface of the first electroconductive member substantially parallel to the surface of the substrate toward the direction in which the end portion of the first electroconductive member and the end portion of the second electroconductive member are set opposite each other is T3 [nm] long, the work function of the second electroconductive member is $\phi wk$ [eV], the voltage applied between the first electroconductive member and the second electroconductive member is Vf [V].

12 Claims, 26 Drawing Sheets

ELECTRON-EMITTING APPARATUS AND IMAGE-FORMING APPARATUS

BACKGROUND OF THE INVENTION

1. Field of the Invention

The present invention relates to an electron-emitting apparatus using an electron-emitting device and an image-forming apparatus.

2. Related Background Art

Conventionally, there are two types of electron-emitting devices, that is, a thermionic cathode electron-emitting device and a cold cathode electron-emitting device. The cold cathode electron-emitting device can be a field emission type (hereinafter referred to as an 'FE type') device, a metal/insulation layer/metal type (hereinafter referred to as a 'MIM type') device, a surface conduction type electron-emitting device, etc.

The surface conduction type electron-emitting device is disclosed by, for example, EP-A1-660357, EP-A1-701265, Okuda et al, "Electron Trajectory Analysis of Surface Conduction Electron Emitter Displays (SEDs)", SID 98 DIGEST, p.185–188, EP-A-0716439, Japanese Patent Application Laid-Open No. 9-265897, No. 10-055745, etc. In addition, to simplify the producing method, a vertical type surface conduction electron-emitting device can be used as disclosed by Japanese Patent Application Laid-Open No. 1-105445, No. 4-137328, and U.S. Pat. No. 5,912,531.

Conventionally, in the above mentioned surface conduction type electron-emitting devices, a gap is normally formed in advance by an energization process referred to as an energization forming in an electroconductive film before emitting an electron.

In some cases, a process referred to as an activation operation in which an organic gas is introduced to a vacuum area for electrification is performed. When the activation operation is performed, a carbon film is formed in the gap formed in the electroconductive film and on a surrounding electroconductive film.

The surface conduction type electron-emitting device handled by the above mentioned process applies a voltage to a electroconductive film, and passes an electric current to the device, thereby emitting an electron from the electron-emitting region.

Conventionally, particularly, for an image-forming apparatus of a display device, etc., a CRT has been replaced with a flat type liquid crystal display device. However, since it is not an emissive type device, there has been the problem that a back light is required. Under such circumstances, an emissive type display device has been requested.

The emissive type display device can be an image-forming apparatus which is obtained as a display device configured by a combination of an electron source containing a number of surface conduction type electron-emitting devices, and a phosphor emitting a visible light by an electron emitted by an electron source.

SUMMARY OF THE INVENTION

FIGS. 25A and 25B show common examples of an electron-emitting apparatus using the surface conduction type electron-emitting device.

In FIGS. 25A and 25B, reference numeral 2001 denotes a substrate, reference numeral 2002 and 2003 denote electrodes, reference numeral 2004, 2006, and 2007 respectively denote an electroconductive film, a gap, and an anode electrode provided above the device. FIG. 25B shows a schematical sectional view of the electron-emitting apparatus. FIG. 25A shows a shape of a beam of an electron emitted onto an anode electrode 2007 of the electron-emitting apparatus shown in FIG. 25B.

In the electron-emitting device, an electron tunnels the gap 2006 when a drive voltage Vf is applied between the electrodes 2002 and 2003, a part of the tunneled electron becomes an emission electron Ie and is emitted to the anode electrode 2007, and the remaining tunneled electron becomes a device current If flowing between the electrodes 2002 and 2003. The value expressed by Ie/If×100% is referred to as efficiency (electron emission efficiency).

In the electron-emitting device such as a surface conduction type electron-emitting device which utilizes a tunneling phenomenon between the electroconductive members opposite each other with a space of the order of nanometer, a large amount of If flows, thereby reducing the electron emission efficiency.

On the other hand, when an image-forming apparatus is formed by using the above mentioned electron-emitting device, a phosphor is provided for the anode electrode 2007 to convert an electronic beam into a light, thereby realizing an image-forming apparatus. However, a high-precision display device has been recently demanded. Therefore, it is necessary to obtain a high-precision beam for use in a high-precision display device. Furthermore, required is a necessary amount of electron emission satisfying the display features for a pixel size appropriate for a high-precision display device. Therefore, improving the electron emission efficiency is required.

The present invention has been achieved to solve the above mentioned problems, and aims at providing a high-performance electron-emitting apparatus and image-forming apparatus capable of improving the electron emission efficiency and realizing a high-precision electronic beam radius.

The electron-emitting apparatus according to the present invention to attain the above mentioned objects comprises:

a substrate;

an electron-emitting device including a layer structure comprising: a first electroconductive member provided on a surface of the substrate; an insulation layer provided on the first electroconductive member; and a second electroconductive member provided on the insulation layer;

an anode electrode provided apart from the surface of the substrate;

first voltage application means for applying potential, higher than the potential applied to the first electroconductive member, to the second electroconductive member; and second voltage application means for applying potential, higher than the potential applied to the second electroconductive member, to the anode electrode, wherein $$T1 < A \times \exp\left[B \times (Vf - \phi wk)/(Vf)\right]$$

$$A = -0.50 + 0.56 \times \log(T3),\ B = 8.7$$

where:

on an end plane of the insulation layer placed substantially parallel to the surface of the substrate, an end portion of the first electroconductive member and an end portion of the second electroconductive member are set opposite each other with a space between;

in a direction of the end portion of the first electroconductive member and the end portion of the second electroconductive member set opposite each other, the second electroconductive film is T1 [nm] long;

the first electroconductive member extending from the surface of the first electroconductive member substantially parallel to the surface of the substrate toward the direction in which the end portion of the first electroconductive member and the end portion of the second electroconductive member are set opposite each other is T3 [nm] long;

the work function of the second electroconductive member is $\phi wk$ [eV];

the voltage applied between the first electroconductive member and the second electroconductive member is Vf [V].

To attain the above mentioned objects of the present invention, the image-forming apparatus comprises:

(A) a first substrate provided with a plurality of electron-emitting devices;

(B) a second substrate having an anode electrode and an image-forming member;

(C) first voltage application means for applying a voltage to the electron-emitting device; and (D) second voltage application means for applying a voltage to the anode electrode, wherein:

the electron-emitting device comprises a layer structure having: a first electroconductive member provided on the surface of the substrate; an insulation layer provided on the first electroconductive member; and a second electroconductive member provided on the insulation layer;

first voltage application means applies potential, higher than the potential applied to the first electroconductive member, to the second electroconductive member;

second voltage application means applies potential, higher than the potential applied to the second electroconductive member, to the anode electrode;

$$T1 < A \times \exp\left[B \times (Vf - \phi wk)/(Vf)\right]$$

$$A = -0.50 + 0.56 \times \log(T3),\ B = 8.7$$

where:

on the end plane of the insulation layer placed substantially parallel to the surface of the substrate, the end portion of the first electroconductive member and the end portion of the second electroconductive member are set opposite each other with a space between;

in a direction of the end portion of the first electroconductive member and the end portion of the second electroconductive member set opposite each other, the second electroconductive member is T1 [nm] long;

the first electroconductive member extending from the surface of the first electroconductive member substantially parallel to the surface of the substrate toward the direction in which the end portion of the first electroconductive member and the end portion of the second electroconductive member are set opposite each other is T3 [nm] long;

the work function of the second electroconductive member is $\phi wk$ [eV];

the voltage applied between the first electroconductive member and the second electroconductive member is Vf [V].

When the above mentioned conditions are satisfied, the times of scattering of electrons emitted from the electron-emitting device can be reduced, and the smaller scattering electron can be used as a main component. Therefore, the electron emission efficiency can be improved, and the high-precision electronic beam radius can be simultaneously realized.

DETAILED DESCRIPTION OF THE PREFERRED EMBODIMENTS

With reference to drawings, suitable embodiments of this invention will be described in detail in an exemplifying manner as follows. However, sizes, qualities, shapes, and relative positions thereof of configuring components described in these embodiments shall not be intended to limit the scope of this invention only thereto unless specific descriptions will be made especially.

In the present embodiment, firstly electron-emitting efficiency will be improved, and secondly electron beam diameters will be made highly accurate and minute. These will be described sequentially.

Firstly, behavior of electrons with respect to a conventional electron-emitting device and behavior of electrons with respect to an electron-emitting device of the present embodiment will be described.

Figure 25A:
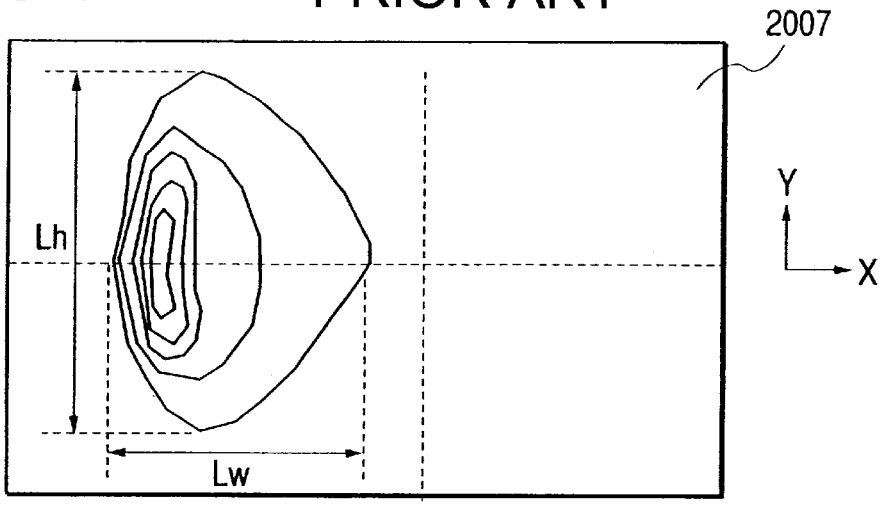
FIG. 25A PRIOR ART
FIGS. 25A and 25B show a conventional plane type surface conduction electron-emitting device.
Figure 25B:
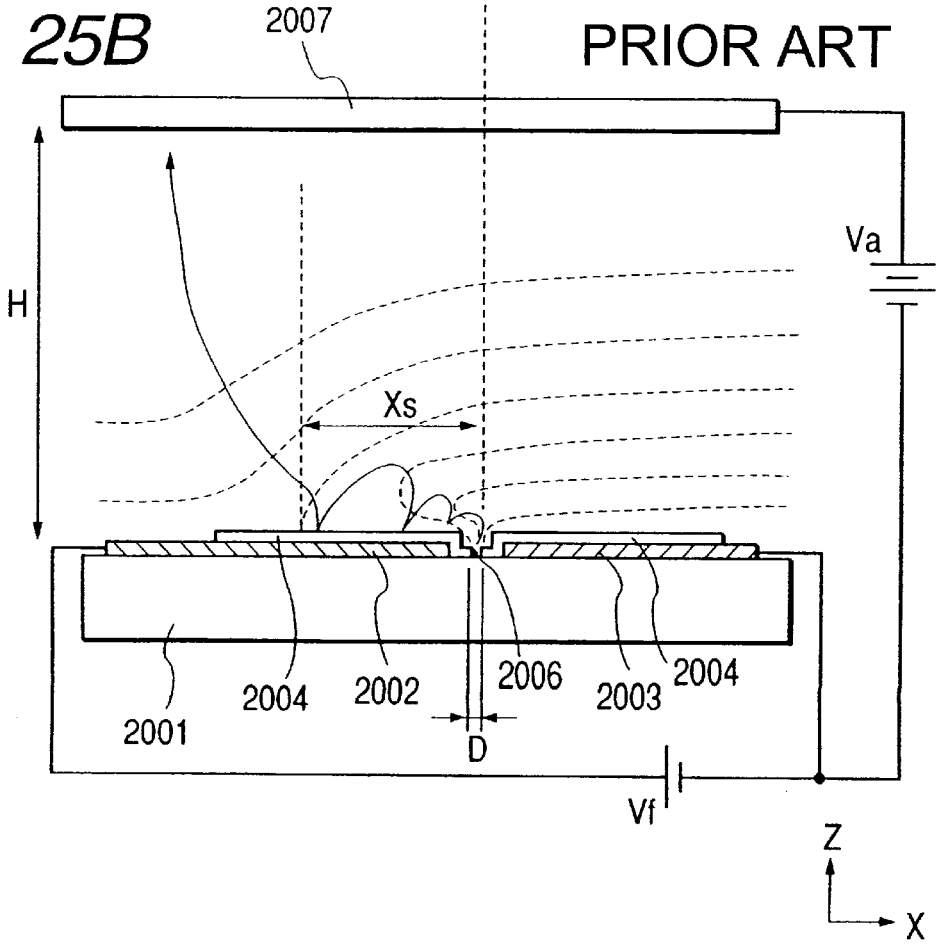
FIG. 25B PRIOR ART

A plane type surface conduction electron-emitting device as shown in FIG. 25B has a gap 2006 of nanometer order, and a conductive member at the higher potential side (a conductive film 2004 and an electrode 2002 disposed at the left side in FIG. 25B) and a conductive member at the lower potential side (a conductive film 2004 and an electrode 2003 disposed at the right side in FIG. 25B) are disposed so as to sandwich this gap.

It is thought that application of voltage Vf [V] to between the electrodes 2002 and 2003 of this device causes an electron to tunnel from the edge of the conductive member at the lower potential side (the edge of the right side conductive film 2004 in FIG. 25B) to the conductive member at the opposing higher potential side, and the tunneled electrons are scattered isotropically at the edge portion of the high potential side electro-conductive member (the edge of the left side conductive film 2004 in FIG. 25B).

Moreover, many of the electrons scattered at the edge of the higher potential side conductive member repeat elastic scattering (multiple scattering) several times on the higher potential side conductive member (the conductive film and/or the electrode 2002 at the left side in FIG. 25B) so that electrons which go over a region from the gap 2006 to a characteristic distance Xs reach an anode electrode 2007.

Here, the characteristic distance Xs is given as follows:

$$Xs=H\times Vf/(\pi\times V3) \quad (1)$$

Here, the reference character H denotes a distance between the electron-emitting device and the anode electrode 2007, and the reference character Va denotes an applied voltage to the anode electrode 2007.

For example, with Va=10 [kV], Vf=15 [V], H=2 [mm] Xs ranges around from 0.95 to approximately 1 $\mu$m.

The characteristic distance Xs is to be understood as distance from an intersection between potential surfaces, equivalent to the higher potential side conductive member, formed in the vacuum space and the higher potential side conductive member to the gap.

Electron-emitting efficiency (hereinafter to be referred to as efficiency) $\eta$ is subject to decrease in electron counts due to a portion thereof being absorbed by the higher potential side conductive member due to multiple scattering during a period with electrons goes beyond Xs.

Electrons which have tunneled out from the edge of the lower potential conductive member are scattered isotropically at the edge of the higher potential side conductive member with losing an energy equivalent to a work function of the higher potential side conductive member ($\phi$wk), and the electrons are scattered again on the higher potential side conductive member.

A ratio $\beta$ on electrons getting scattered is not clarified yet, but is estimated as from 0.1 to around 0.5 and normally around 0.3 a time.

Such a scattering mechanism with $\beta$ being not more than 1 explains that the quantity of electrons to be emitted to the vacuum space decreases exponentially.

The electrons after having past the above described characteristic distance Xs trace the electron tranjectory reflecting the influence of the space potential formed with a voltage applied to the anode electrode 2007 (Va [V]) and a drive voltage (Vf [V]) of the device to reach the anode electrode 2007.

Behavior of electrons emitted from the electron-emitting device according to the present invention as well as improvement of efficiency thereof will be described as follows.

Due to the above described mechanism, in the present invention, in order to improve electron-emitting efficiency, the number of occurrence of scattering (occurrence of drop) of electrons on the higher potential side conductive member shall be configured to be decreased.

Figure 1A:
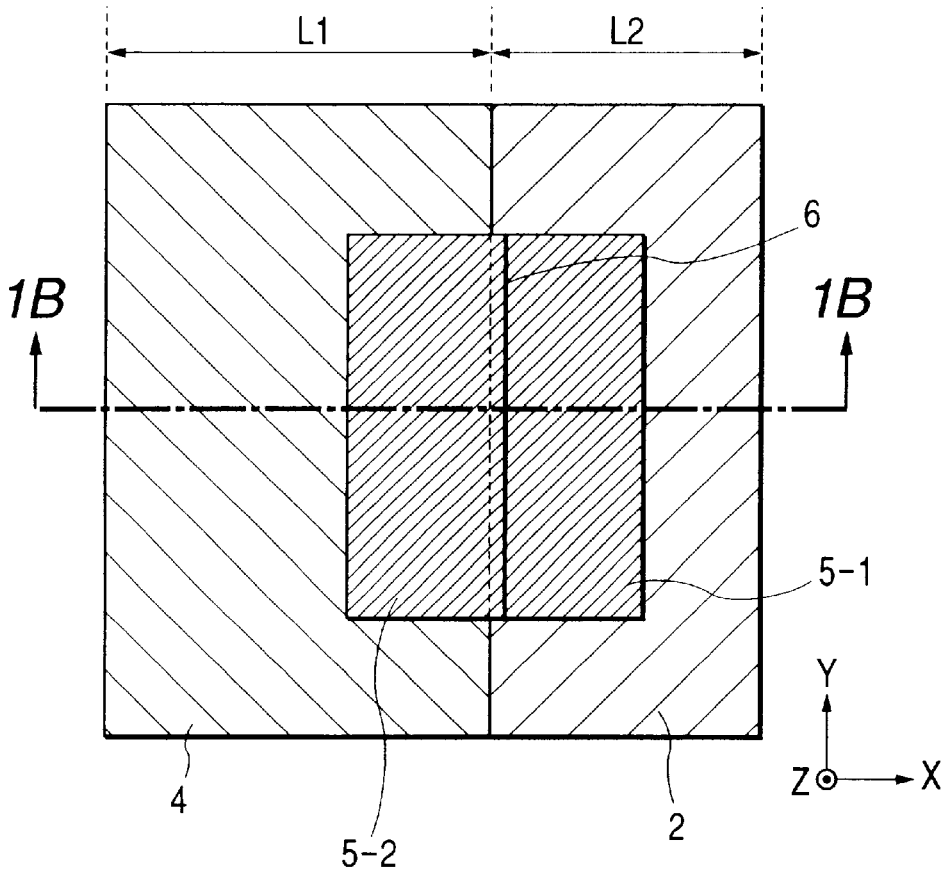
FIGS. 1A and 1B show an example of a basic electron-emitting device according to the present invention.
Figure 1B:
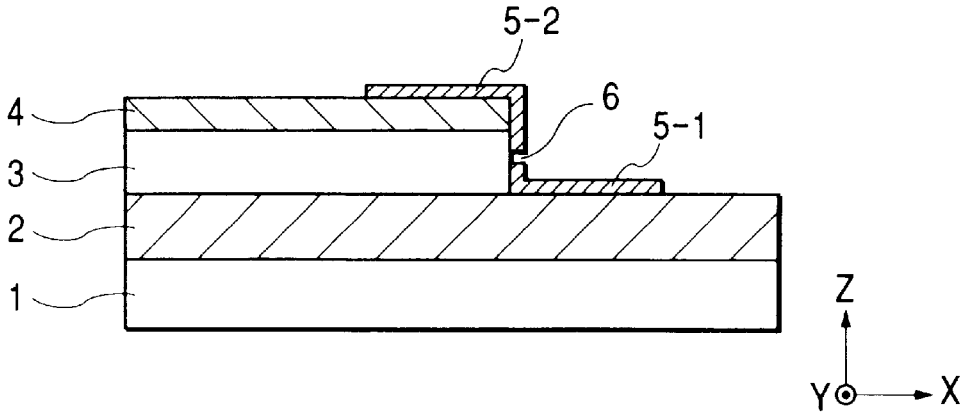

FIGS. 1A and 1B are block diagrams showing an electron-emitting device as an example of the present invention. FIG. 1A is a plan view while FIG. 1B is a sectional view along the line 1B—1B. Reference numerals 1, 2, 3, 4 respectively denotes a substrate, a lower potential electrode, a insulating layer, a higher potential electrode, and reference numerals 5-1 as well as 5-2 denote a conductive film, and a reference numeral 6 denotes a gap.

The first conductive film 5-1 and the second conductive film 5-2 that are facing each other with the gap 6 being disposed inbetween are respectively brought into connection with the electrodes 2 and 4. One end of the second conductive film 5-2 is brought into connection with the higher potential electrode 4 and one end of the first conductive film 5-1 is brought into connection with the lower potential electrode 2.

In addition, the above described lower potential electrode is disposed on a surface (main surface) of the above described substrate 1. Therefore, the above described lower potential electrode 2 has a surface substantially in parallel with the surface (main surface) of the above described substrate 1.

Figure 2:
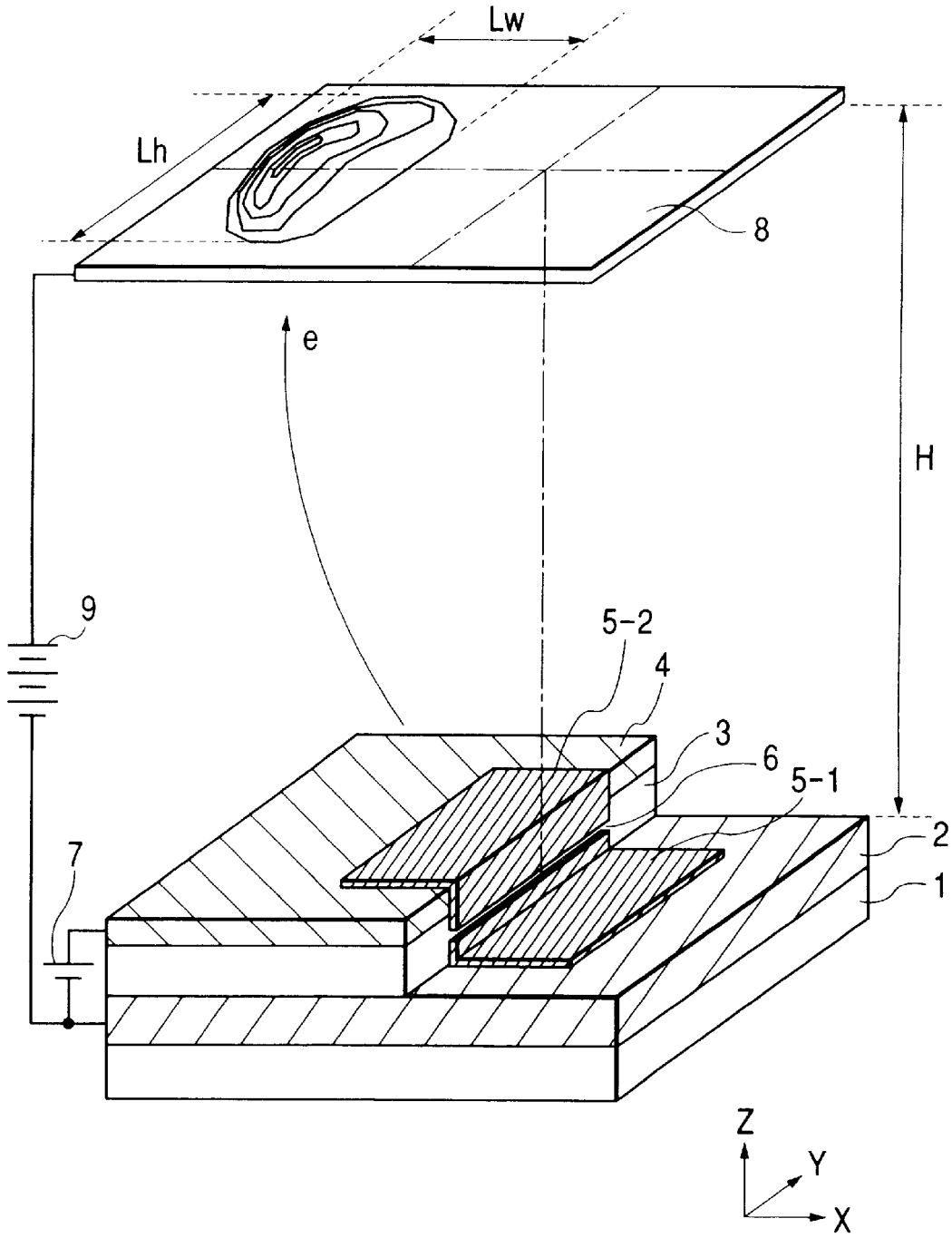
FIG. 2 is an oblique view of a typical arrangement of an electron-emitting device according to the present invention.

A general disposition example is shown in FIG. 2 to obtain an electron beam by driving this device. Here, reference numeral 7 denotes a power source (voltage applying means) to apply a driving voltage (Vf [V]) between electrodes 2 and 4 of the device. Reference numeral 8 denotes an anode electrode to draw up and capture electrons emitted from the device. The anode electrode 8 and the electron-emitting device are disposed to keep a distance H and a high voltage power supply 9 applies an anode voltage (Va [V]) to the anode electrode 8. The above described voltage Vf is a difference between a potential being applied to the lower potential side electrode 2 and a potential being applied to the higher potential side electrode 4. In addition, the above described voltage Va is a difference between a potential being applied to the lower potential side electrode 2 and a potential being applied to the anode electrode 8.

Here, the distance H between the anode electrode 8 and the electron-emitting device may be substantially taken as the distance between the substrate 1 and the anode electrode without giving rise to any problem.

The driving voltage Vf being applied between the higher potential electrode 4 and the lower potential electrode 2 will give rise to a current If [A] to flow there, and the voltage Va [V] being applied to the anode electrode 8 will give rise to a current Ie [A] to flow due to electrons being captured by the anode electrode 8, and the efficiency is shown as follows:

$$\eta=(Ie/If)\times 100[\%].$$

Figure 3:
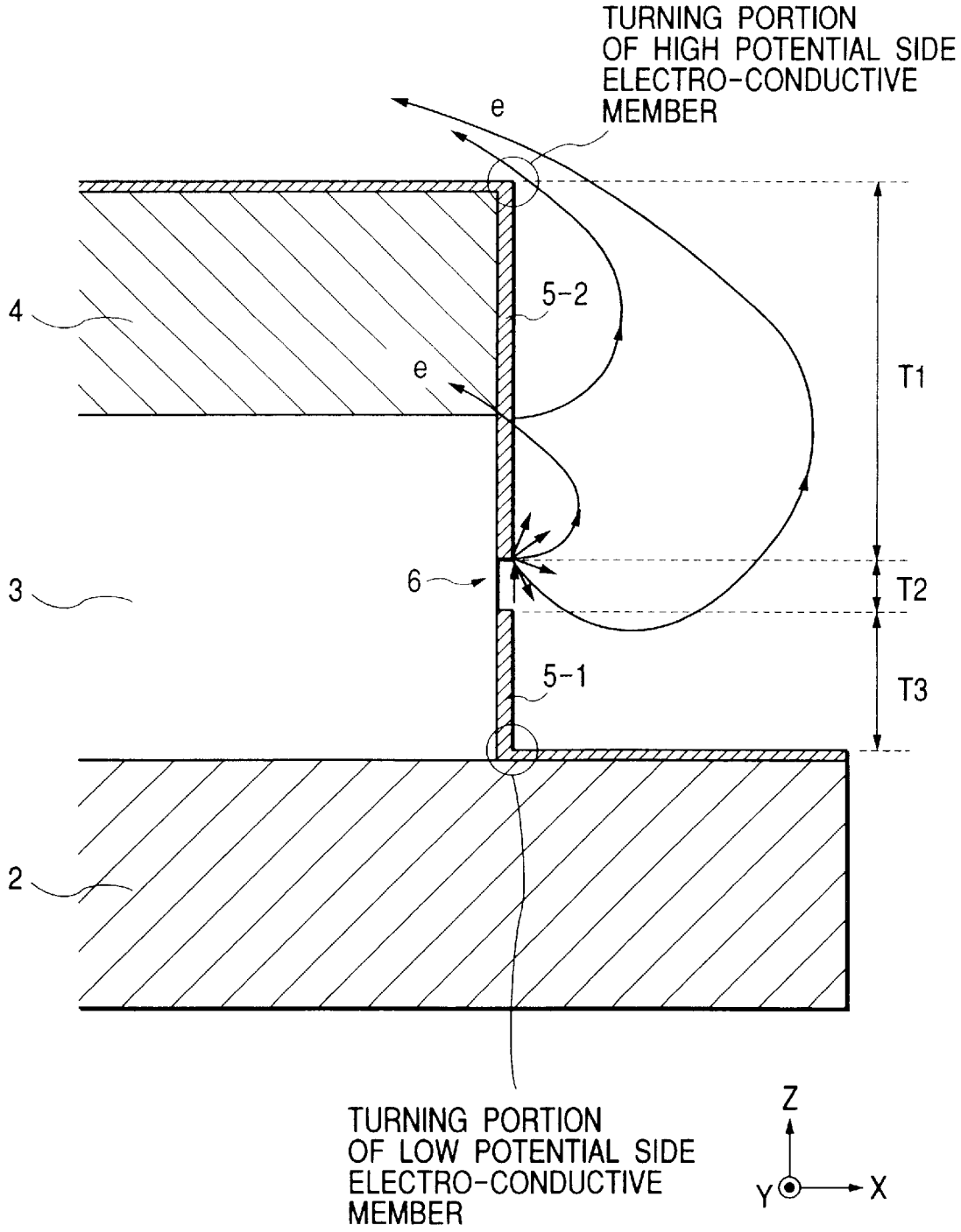
FIG. 3 is an enlarged sectional view of the electron-emitting region shown in FIGS. 1A and 1B.

Moreover, FIG. 3 is an enlarged view of the electron-emitting region in this disposition.

In FIG. 3, reference numerals 6, 4 and 2 respectively denote a gap, a higher potential electrode and a lower potential electrode, and reference numerals 5-1 and 5-2 respectively denote a conductive film being brought into connection with the lower potential electrode and a conductive film being brought into connection with the higher potential electrode.

In the present invention, the higher potential side electrode 4 inclusive of the second conductive film 5-2 will be referred to as "higher potential side conductive member." In addition, the lower potential side electrode inclusive of the first conductive film 5-1 will be referred to as "lower potential side conductive member."

Accordingly, a higher potential side conductive member and a lower potential side conductive member can be described to structure a laminated configuration with an insulating layer being sandwiched inbetween. And this laminated body (a high potential side conductive member, an insulating layer and a low potential side conductive member) is disposed on a surface (main surface) of the above described substrate 1, and the direction of lamination thereof is substantially in perpendicular to the surface of the above described substrate 1.

Therefore, as shown in FIG. 3 and FIGS. 1A and 1B, in an electron-emitting device of the present invention, on an end surface of the above described insulating layer 3 in a substantially parallel direction along the surface (main surface) of the above described substrate 1, an end portion of the above described first conductive member (an end portion of the first conductive film 5-1) and an end portion of the second conductive member (an end portion of the second conductive film 5-2) are disposed so as face each other with a gap inbetween.

Restating this configuration, on an end surface of the above described insulating layer 3 in a substantially parallel direction along the surface (main surface) of the above described substrate 1, an end of the above described first conductive member (an end of the first conductive film 5-1) and an end of the second conductive member (an end of the second conductive film 5-2) are disposed, and edges of respective parties are disposed so as to face each other with a gap 6 inbetween.

Incidentally, details will be described later, but an angel provided by "the end surface of the above described insulating layer 3 in a substantially paralleled direction along the surface (main surface) of the above described substrate 1" and "the surface (main surface) of the above described substrate 1" is preferably not less than 45 degrees and not more than 100 degrees, and moreover is particularly preferably not less than 90−10 degrees and not more than 90+10 degrees.

In addition, in this gap 6, as will be described later, electrons are caused to tunnel from the edge of the lower potential side conductive member toward the edge of the higher potential side conductive member and as a consequence thereof, electrons are emitted.

In FIG. 3, T1, T2 and T3 are lengths of devices to be determined from potentials thereof and are different from simple thickness of an electrode and simple thickness of an insulating layer, etc.

That is, reference character T1 denotes a distance from an end of the gap 6 to a turning portion of the high potential side electro-conductive member, a reference character T2 denotes width of the gap 6 along the direction (the direction Z in FIG. 3) where the low potential side electro-conductive film 5-1 and the high potential side electro-conductive film 5-2 are facing each other, and a reference character T3 denotes distance from an end of the gap 6 to a turning portion of the low potential side electro-conductive member.

In other words, the reference character T1 denotes length of the second electro-conductive film 5-2 along the direction (the direction Z in FIG. 3) where the above described first electro-conductive film 5-1 and the second electro-conductive film 5-2 are facing each other via the above described gap 6. The reference character T2 denotes length of the first electro-conductive film 5-1 along the direction (the direction Z in FIG. 3) where the first electro-conductive film 5-1 and the second electro-conductive film 5-2 are facing each other.

In other words, the reference character T1 can be said to denote length of the above described second electro-conductive member in the direction where an end portion of the above described first electro-conductive member and an end portion of the second electro-conductive member face each other in a side of the above described insulating layer 3 (an end surface of the above described insulating layer 3 in the direction in substantially parallel along the front surface of the above described substrate 1).

In addition, as described above, in a device of the present invention, the low potential electrode 2 has a surface in substantially parallel to a surface (main surface) of the above described substrate 1 and therefore the reference character T3 can be said to denote length of the above described first electro-conductive member elongating from the surface of the above described first electro-conductive member in substantially parallel to the surface (main surface) of the above described substrate in the direction where an end portion of the above described first electro-conductive member and an end portion of the second electro-conductive member face each other in a side of the above described insulating layer 3 (an end surface of the above described insulating layer 3 in the direction substantially parallel to the surface (main surface) of the above described substrate 1).

Or, likewise, in the device of the present invention, since the low potential electrode 2 and the low potential side electro-conductive film 5-1 have surfaces substantially in parallel along the surface (main surface) of the above described substrate 1, the reference character T3 can be said to denote length of the above described first electro-conductive film elongating from the surface of the above described low potential electro-conductive film 5-1 in substantially parallel along the surface of the above described substrate in the direction where an end portion of the above described first electro-conductive film and an end portion of the second electro-conductive film face each other.

The present invention extended earnest studies on most suitable regional length in order to first obtain high efficiency, and therefore, set mainly the length of T1.

In the present embodiment, when a driving voltage Vf [V] is applied between electrodes 2 and 4, electrons are emitted under an emitting mechanism similar to a prior art plane type electron-emitting device. That is, electrons are caused to tunnel from the edge of the low potential side electro-conductive member toward the facing high potential side electro-conductive member to get scattered isotropically at the edge portion of the high potential side electro-conductive member. Many electrons that got scattered from the edge Aportion of the high potential side electro-conductive member repeats elastic scattering from one time over to several times on the high potential side electro-conductive member.

However, a vertical type shown in FIG. 3 and a conventional plane type shown in FIGS. 25A and 25B are respectively provided with different distributions of space potential configured with the potential of the anode electrode 8 and the potential of the device. Therefore, as shown in FIG. 3, a part of electrons that got scattered isotropically at the edge portion of the high potential side electro-conductive member no longer get scattered with the high potential side electro-conductive member 4 but reach the upper part of the turning end portion of the high potential electrode 4 and will reach the anode electrode 8 without being interrupted.

Thus, control of scattering on the high potential side electro-conductive member will be important for improvement of electron-emitting efficiency.

In case of a conventional plane type, it is presumed that the electron-emitting efficiency is determined by distribution in arrival of scattered electrons and, the characteristic distance Xs or Xs≅γ×Xs (the coefficient γ=0.67) as disclosed in Okuda et al. "Electron Trajectory Analysis of Surface Conduction Electron Emitter Displays (SEDs)", SID 98 DIGEST, P. 185–188, etc.

In addition, distribution in arrival of scattered electrons is related to the maximum flight distance of electrons, and is normalized with a coefficient C that is determined by width D of the gap 6 (that is defined as T2 in FIG. 3), the driving voltage and a work function (that is defined as work function ϕwk of the high potential side electro-conductive member in the present invention).

The maximum flight distance of electrons relates to the efficiency in the electron-emitting device of the present invention. However, space potential distribution configured by the drive voltage Vf of the anode electrode 8 as well as the device will be different from the plane type and be complicated as described above.

When a turning portion of the high potential side electro-conductive member is configured within a region not more than the above described characteristic distance Xs, the efficiency does not depend on Xs but is determined mainly by the distance of T1.

Moreover, T1 is made less than the maximum flight distance to the first scattering (the first scattering after scattering occurs at the edge of the high potential side electro-conductive member) so that electrons without getting scattered (that is, electrons that get scattered only at the edge of the high potential side electro-conductive member but does not get scattered thereafter) are generated.

As described so far, in the present invention, as result of detailed studying behavior of electrons under a vertical type, especially scattering behavior, designing is made in terms of work function ϕwk of a material used for the high potential area (a material used for the second electro-conductive member) and an equation of driving voltage Vf and moreover an equation of distance of T1 and T3, that is, the shape in the vicinity of the electron-emitting region, thereby an electron-emitting device sizably improving efficiency was obtained.

Figure 4A:
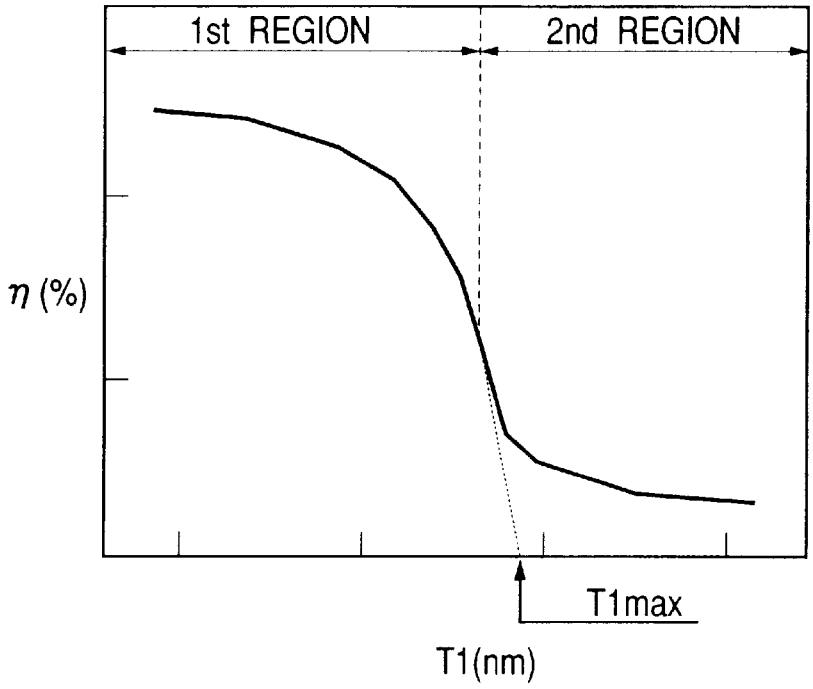
FIGS. 4A and 4B are graphs showing an improvement of an efficiency according to the present invention.

An electron-emitting device of the present invention will be described in detail with reference to FIGS. 4A and 4B and FIGS. 5A and 5B as follows. FIG. 4A is an example of a graph showing correlation between T1 and efficiency while FIG. 4B is a graph where electron-emitting efficiency η in FIG. 4A is shown in terms of scattering times of electrons.

Figure 4B:
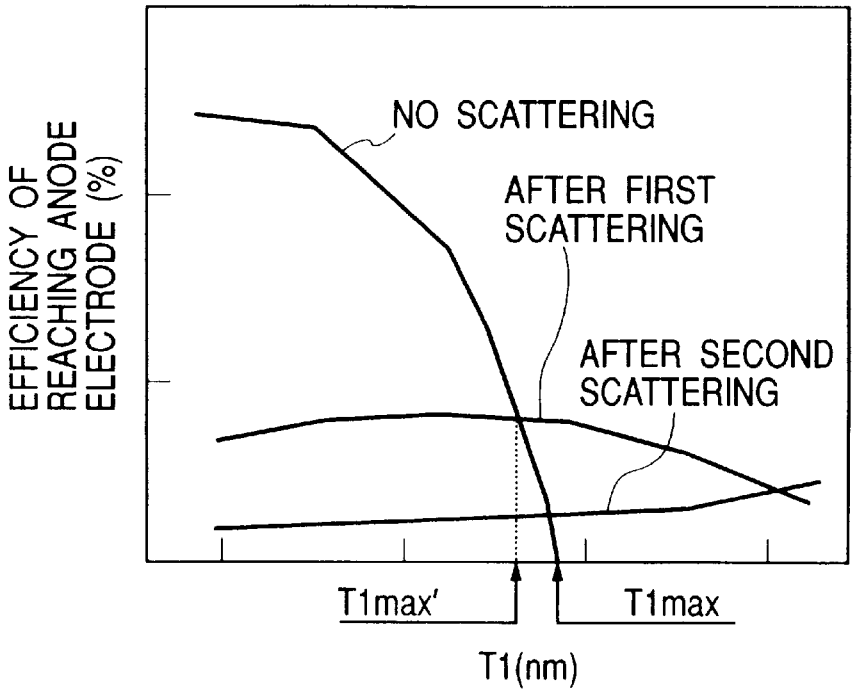

In FIGS. 4A and 4B, the horizontalfs axis is scaling for T1 [nm] and is indicated by logarithms. The vertical axis is for efficiency η in FIG. 4A. The vertical axis in FIG. 4B is for efficiency in terms of scattering times of electrons.

As shown in FIG. 4A, the efficiency is divided into a first region where the efficiency decreases rapidly as T1 gets larger and a second region where the subsequent efficiency drop decreases. This is correlated with scattering times of electrons. The first region is considered to be a region where electrons without scattering (electrons that get scattered only at the edge of the high potential side electro-conductive member but doe not get scattered thereafter) occupy majority of electrons reaching the anode electrode while the afterward second region is considered to be a region where electrons subject to a plurality of time of scattering occupy majority.

As shown in FIG. 4B, the reaching region of electrons without scattering (electrons that get scattered only at the tip of the high potential side electro-conductive member but do not get scattered thereafter) is indicated by T1max and is indicated in FIG. 4A as a point where the first stage efficiency drop curve is extraporated with η=0.

In addition, the intersection of the first region and the second region is indicated by T1max' in FIG. 4B, and this point is deemed as a turning point where the main scattering occurrence count changes.

Figure 5A:
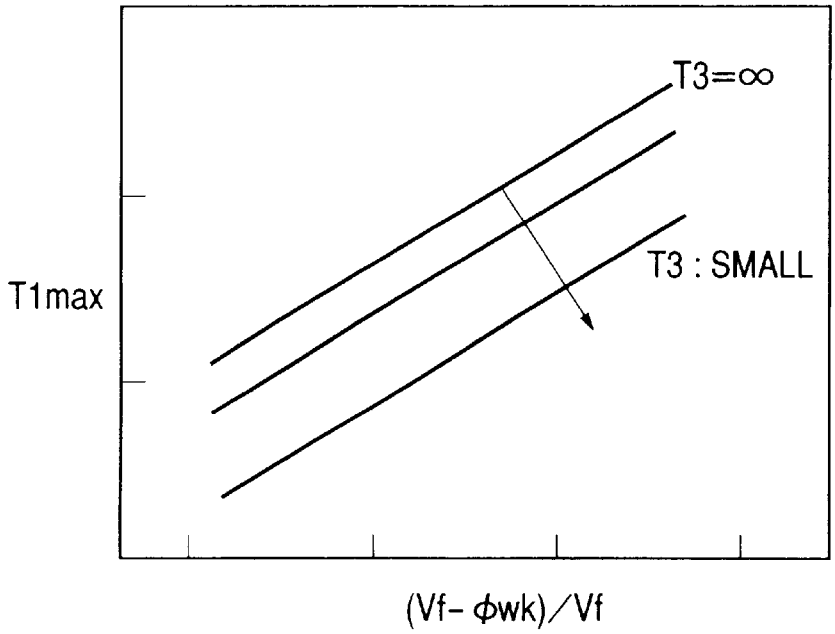
FIGS. 5A and 5B are a graph and an explanatory view showing the improvement of the efficiency according to the present invention.

FIG. 5A shows the relationship among Vf (driving voltages of the device), ϕwk (work function of the high potential side electro-conductive member) and T1max with graphs. The horizontal axis is linearly scaled while the vertical axis is scaled in logarithms. Once the driving conditions are determined, a shape that causes effects to be expected for efficiency improvement, that is, electrons without scattering to be reachable to the anode electrode can be obviously determined.

Figure 5B:
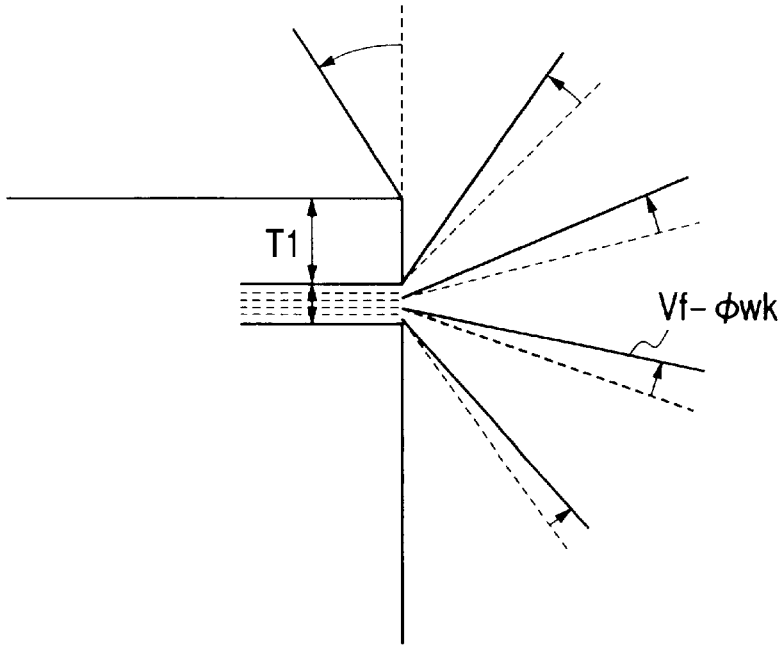

Description on (Vf−ϕwk)/Vf scaled in the horizontal axis is shown in FIG. 5B.

In the case when Vf is the driving conditions, an electric field so as to equally divide the space is formed in the vicinity of the electro-emitting region 5. Equipotential surface of (Vf−ϕwk), which will be the position shown with a bold line in FIG. 5B, can be said to operate as a wall so as not to cause the emitted electrons any more to reach the low potential side from this surface.

Changes in T1 give rise to changes in position of this equipotential surface together with changes in direction and intensity of the electric field, resulting in changes in trajectoies of electrons. The characteristic distance Xs or the gap width T2 being around 200 times larger in rough calculation causes this electric field to affect electrons significantly.

In the present invention, the gap width T2 is from several nm to several ten nm, and with T1 being set at from several ten nm to several hundred nm a region significantly affective to flight of scatterd electrons will appear and shape effect can be expected.

In addition, in the graph in FIG. 5A, dependency of T1max on T3 is shown. As T1, it is obvious that the shape of T3 is a factor to give rise to changes in electric filed in the periphery of the gap.

However, smaller T1 is, more effectively the efficiency is improved while, larger T3 is, more effectively the efficiency is improved to result in approximately a constant with T3=∞, which represents difference.

From the graph in FIG. 5A, T1max is given by the following equation:

$$T1\max = A \times \exp[B \times (Vf - \varphi wk)/(Vf)] \quad (2)$$

-continued $$A = -0.78 + 0.87 \times \log(T3)$$

$$B = 8.7$$

Here, reference characters T1 and T3 denote distance (with unit of nm), ϕwk denotes values of work function of the high potential side electro-conductive member (with unit of ev), Vf denotes driving voltages (with unit of V), A denotes an equation of T3 and B denotes a constant.

Moreover, as a result of study, it has become obvious that the turning point T1max' where the above described main scattering occurrence count changes can be approximated by changes in coefficient in the equation of A in the equation (2).

Accordingly, the following equations are lead:

$$T1\max' = A' \times \exp[B \times (Vf - \varphi wk)/(Vf)] \quad (2)'$$

$$A' = -0.50 + 0.56 \times \log(T3)$$

$$B = 8.7$$

As described so far, T1 is important for electron-emitting efficiency as a parameter related to scattering and with T1 being set within a range given by the equation (2) and more preferably the equation (2)' it is obvious that remarkable effect in efficiency improvement will be obtainable, and in the present invention, T1 is limited within the range given by the equation (2)'.

Figure 6:
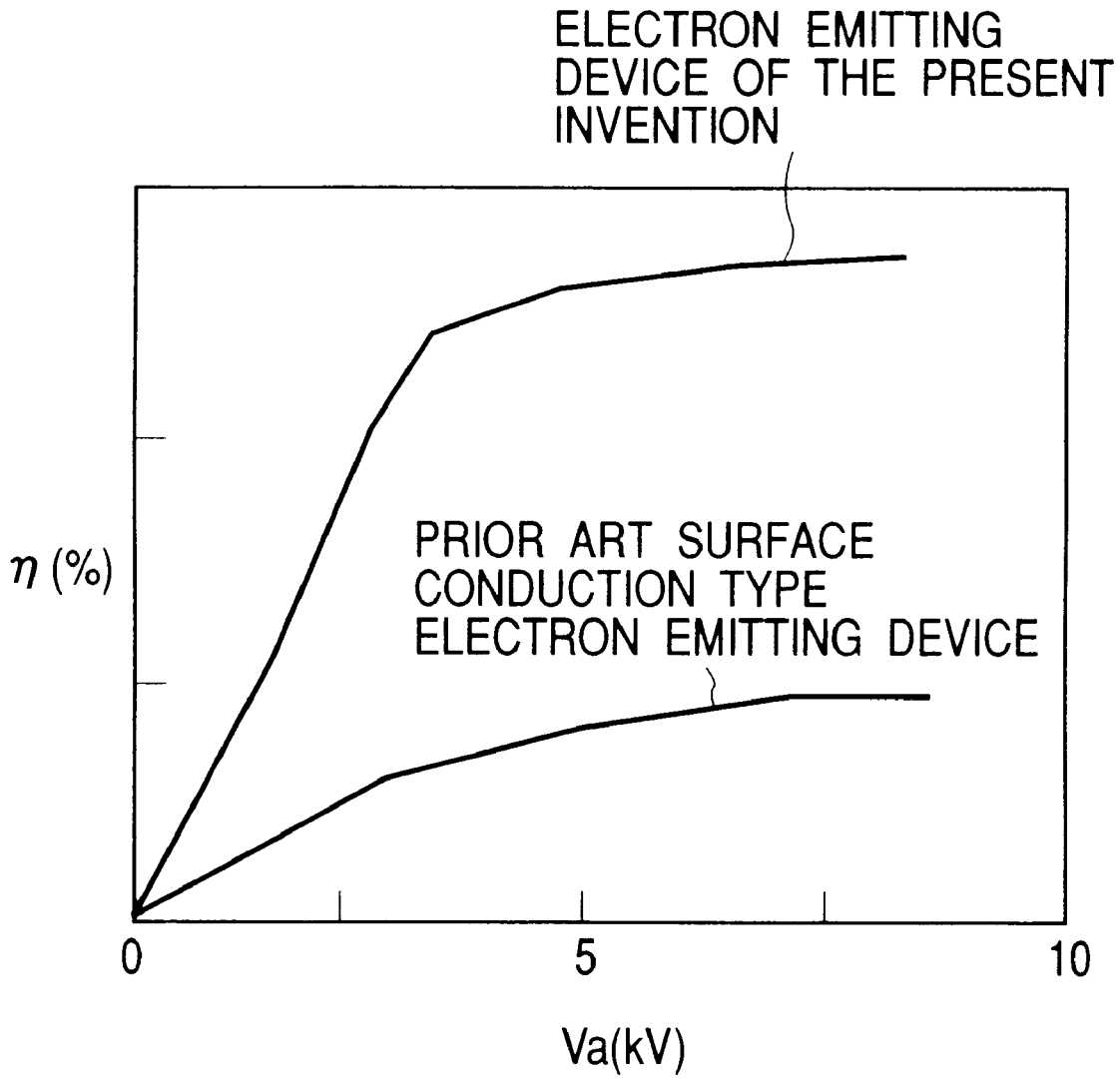
FIG. 6 is a graph showing the improvement of the efficiency according to the present invention.

Moreover, in FIG. 6, electron-emitting characteristic of the configuration according to the present invention is shown in comparison with a prior art plane type electron-emitting device. In the electron-emitting device according to the present invention, efficiency varies to increase largely in the low Va side. Accordingly, realization of the configuration of the present invention can enable driving of lower Va.

Here, in order to produce the configuration according to the present invention, it is important to control film thickness of a laminated layer of the electrodes 2 and 4 and the insulating layer 3. In particular, it will become necessary to control film thickness of the insulating layer 3 as well as the high potential electrode 4.

On the other hand, the configuration according to the present invention does not have minute shape pattern around several μm, and accordingly, no expensive manufacturing machines for patterning is necessary. For example, in the case where photolithography step is used, simpler manufacturing method can be selected. In addition, position accuracy for x direction as well as y direction can be set comparatively loosely.

Next, highly accurate minuteness of the electron beam diameter with the electron-emitting device of the present invention will be described.

The electron beam diameter of a prior art plane type electron-emitting device is approximated by the following equations according to SID98Digest, Okuda, et. al:

$$Lh \simeq 4 \times Kh \times H \times \sqrt{(Vf/Va)} + LO \quad (3a)$$

$$Lw \simeq 2 \times Kw \times H \times \sqrt{(Vf/Va)} \quad (3b)$$

Here, reference character Lh denotes electron beam diameter in the y direction, reference character Lw denotes electron beam diameter in the x direction, and reference character L0 denotes device length in the y direction. In addition, reference characters Kh and Kw denote coefficients to be set at from 0.8 to 0.9 for Kh and at from 0.8 to 1.0 for Kw.

In addition, under Va=10 kV and H=3 mm, sizes of 0.5 mm from Lh and 0.25 mm from Lw have been obtained.

Since the device of the present invention is to propose such a configuration as to make T1 less than a fixed value, in the case of observing it from the anode electrode side, its distance is sufficiently short and as in the prior art plane type device, equations (3a) and (3b) are generally applicable. However, difference in coefficients of Kh and Kw is obvious, and in particular, the value of Kw being the coefficient of the electron beam diameter in the x direction become small to realize highly accurate minuteness of the electron beam diameter.

Figure 7:
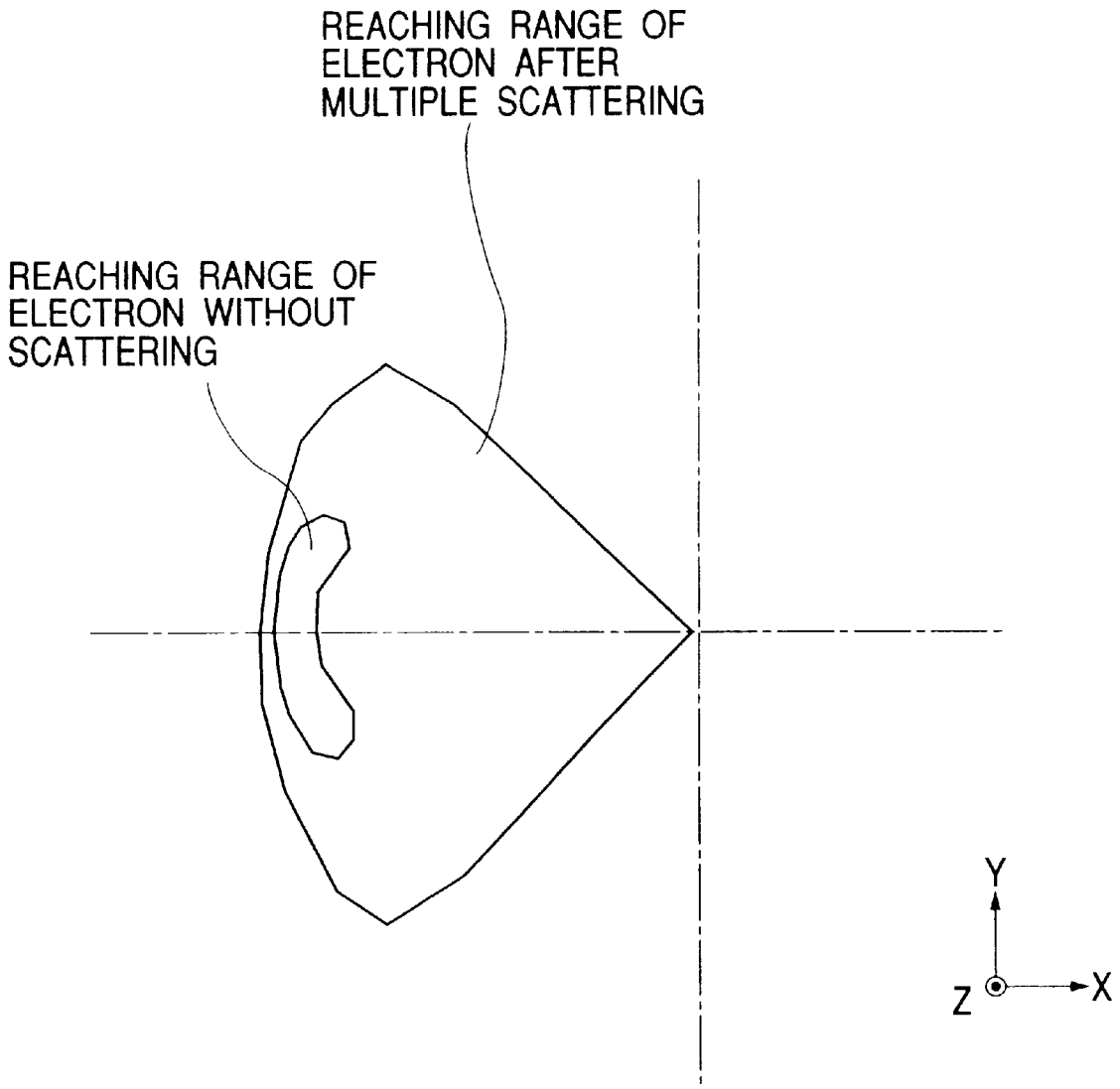
FIG. 7 shows a high-precision beam according to the present invention.

FIG. 7 shows a maximum reaching position of electrons in terms of scattering times of electrons of the device according to the present invention.

Electrons are caused to turn in the x direction due to influence of curved space potential formed on the high potential electrode, but when scattering takes place on the high potential electrode, the trajectoies thereof are changed so that the reaching point of the electron beam varies and its span will be put inside the fan shape. However, its intensity distribution is not uniform, and as the scattering times grow less, it tends to get biased to the fan-shaped outer periphery, and in particular in there in the vicinity of the origin in the y direction.

On the other hand, electrons without getting scattered (that is, electrons that get scattered only at the edge of the high potential side electro-conductive member but does not get scattered thereafter) is left to hold orientation at the time of emission only to reach a specific region as shown in FIG. 7 since the space potential determined by the driving voltage and the anode voltage cause its trajectoy to turn.

In the configuration according to the present invention, average times of scattering of electrons reaching the anode electrode are decreased so that the intensity distribution of the electron beam can be concentrated to the fan-shaped outer periphery. As a result thereof, relative intensity distribution in the x direction as well as in the y direction can be made to change.

The electron beam shape is normally defined by the length of region subject to sufficient attenuation in intensity ratio against peak intensity, and therefore changes in intensity distribution can make the electron beam shape get smaller.

In addition, as defined by the above described equation (2)', selecting a shape having a main component of electrons reaching the anode electrode as the component without scattering, the electron beams can be collected inside an extremely narrow region as further shown in FIG. 7 so that Kw and Kh are made to reduce.

As shown in the present embodiment so far, the present invention reduces the number of scattering occurrence and utilizes electrons without getting scattered (that is, electrons that get scattered only at the edge of the high potential side electro-conductive member but does not get scattered thereafter) as a main component so that high electron-emitting efficiency is compatible with convergence of highly accurately minute electron beam diameter.

Moreover, preferable application range of T1 will be described.

From the description on the above described number of scattering occurrence, in terms of the efficiency η, T1 is required ideally to be 0. However, T1 needs to have a role as an electrode to provide with potential. Accordingly, minimum thickness will be necessary. Thickness being thin will give rise to a parasitic resistant and result in reduction in a voltage applied to the gap portion and moreover, can be a factor to cause deterioration in the device due to a drop in heat resistance.

In addition, as T1 approaches 0, there was a case where the gap was formed not at the side wall of the insulating layer but at the end of the insulating layer at the opening (gap) facing in the anode electrode direction, but in this case, a desired result as to efficiency as well as electron beam diameter was not always obtained but dispersion in devices was increased.

This relates to the direction of the gap, and in the present embodiment, the gap opening in perpendicular to the side wall of the insulating layer can be said to be a prerequisite at the time of realization of the above described conditional equations.

Accordingly, T1 for practical use in the present invention needs to have at least about 10 nm.

In addition, in the case where T1 is made extremely thin, a certain anode voltage Va controls scattering on the side surface covering the turning portion of the high potential side electro-conductive member, but on the other hand, thereafter, a component getting scattered on the upper surface portion of the high potential side electro-conductive member (the surface facing the anode electrode) arises and it was revealed that the efficiency η only dropped and the beam diameter Lw was widened.

Figure 8A:
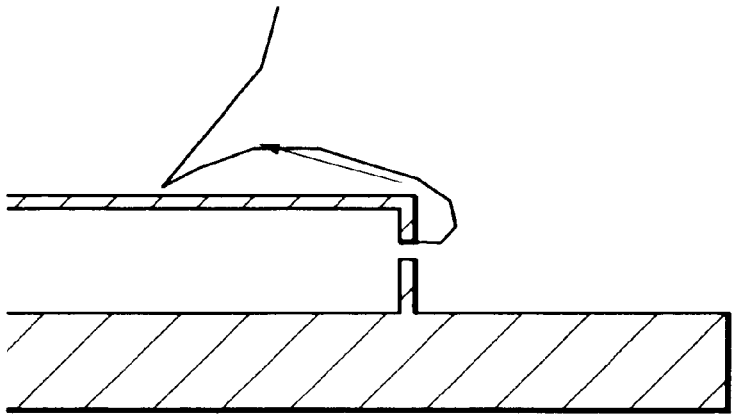
FIGS. 8A and 8B show an example of a T1 dependency according to the present invention.

The above described description is shown in FIG. 8A. This shows that the efficiency depends on the direction component of the electrons passing the turning portion of the high potential side electro-conductive member without getting scattered.

Figure 8B:
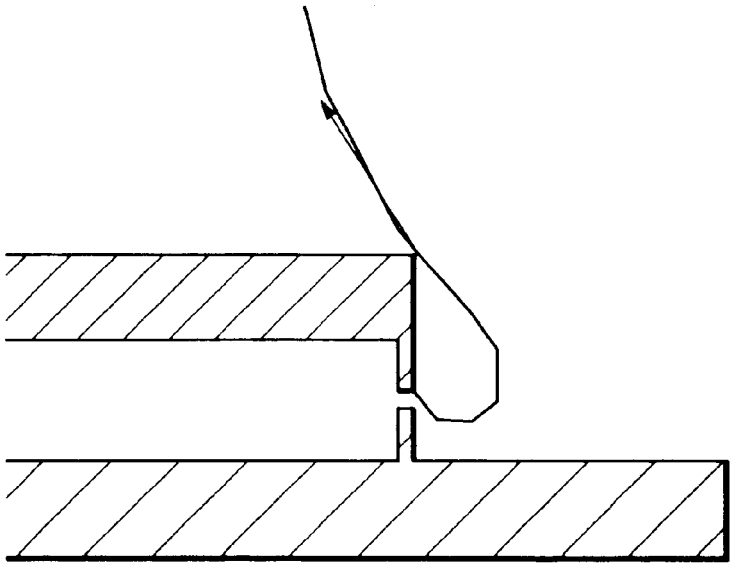

That is, as shown in FIG. 8B, it is considered that T1 had better have thickness to a certain extent to control a component with low angles among angles heading for the anode electrode with multiple scattering and to limit the component directly heading for the anode electrode so that further accurate electron beams will become available.

Thus, even if T1 gets thin in the graph in FIG. 4A, the efficiency as well as the electron beam diameter are not so improved and no further improvement in characteristics is visible. The region where saturation in this characteristics was observed can be said to be $T1 \leqq T1max'/2$, nevertheless depending on condition of the anode voltage Va.

At the time of using this region, dispersion in characteristics for dispersion in positions of the electron-emitting region can be relieved and advantageous for uniformity.

Accordingly, preferable T1 in the present embodiment falls within $0<T1<T1max'$ and more preferably $0<T1 \leqq T1max'/2$. On the other hand, practical determination will fall within $10\ nm \leqq T1<T1'max$ and more preferably $10\ nm<T1 \leqq T1max'/2$.

Moreover, a necessary prerequisite for realization of the equations (2) and (2)' will be additionally described.

Figure 9A:
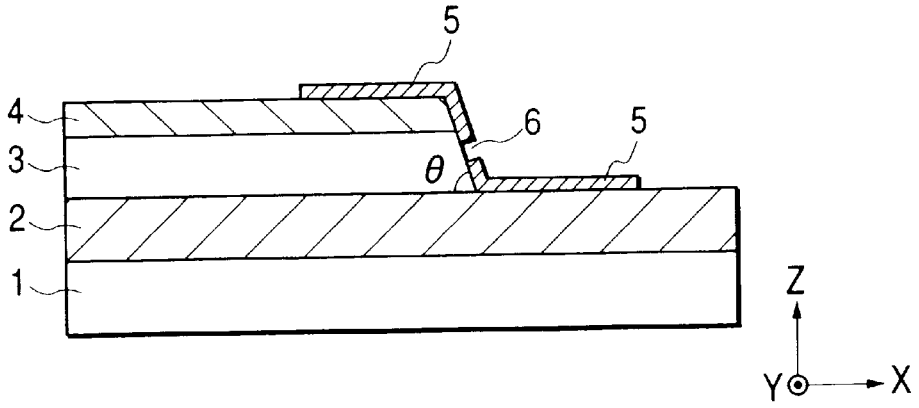
FIGS. 9A and 9B show an inclination angle θ of the device according to the present invention.
Figure 9B:
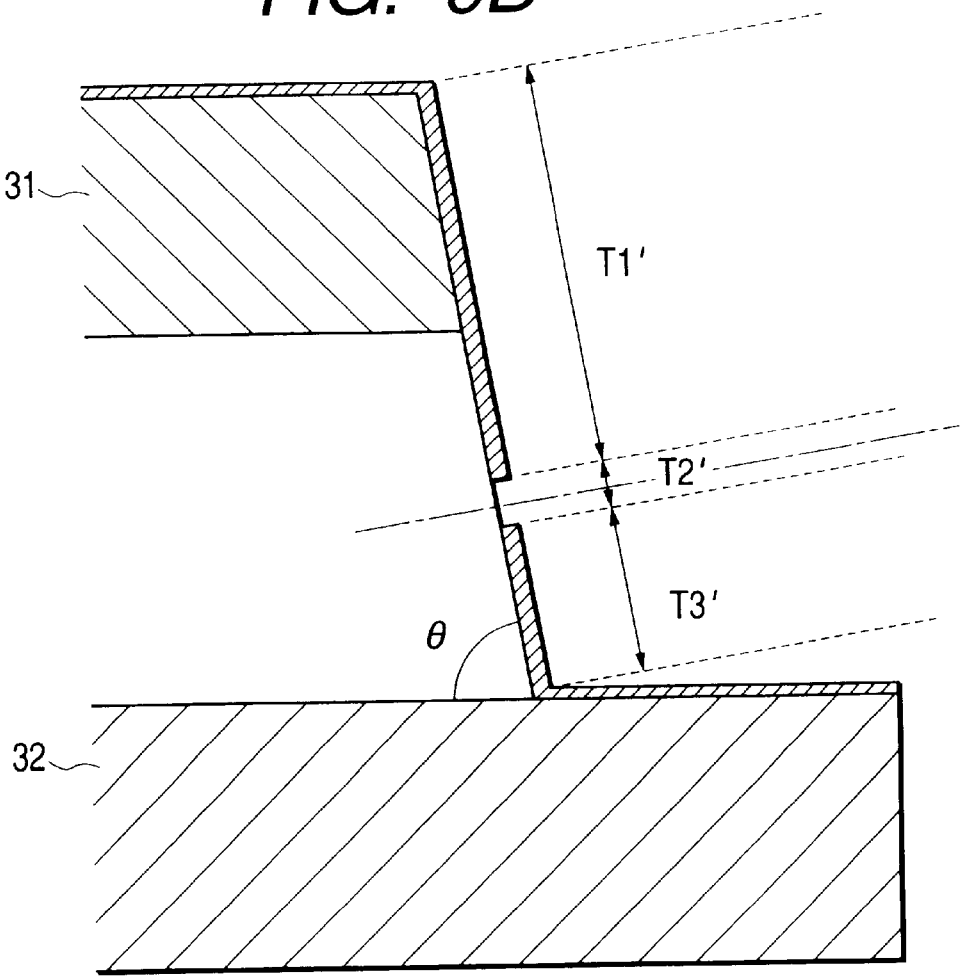

FIGS. 9A and 9B show a case where an electron-emitting device of the present invention was formed on a side wall of the insulating layer having an inclination. In addition, FIGS. 10A and 10B show graphs showing relationship between an inclination angle and efficiency as well as electron beam diameter.

So far, the electron-emitting device in the case where it is formed on the insulating layer 3 having a sectional view perpendicular to the plane of the substrate 1 as a sectional view was described and conditions were determined. However, in the production step of the device, it is difficult to form the sectional face of the insulating layer 3 as well as the high potential electrode 4 completely perpendicularly, and in general it is normal that, as shown in FIGS. 9A and 9B, it is formed with a certain angle θ against the surface of the substrate 1 (the surface of the electrode 2).

Even in the case where inclination exists, in the case where θ is close to 90 degrees (within the range of 90 degrees±10 degrees), as shown in FIG. 9B, lengths in parallel along the sectional face are replaced with T1', T2' and T3' to substantially realize the prerequisite of the above described (2) and (2)'.

Figure 10A:
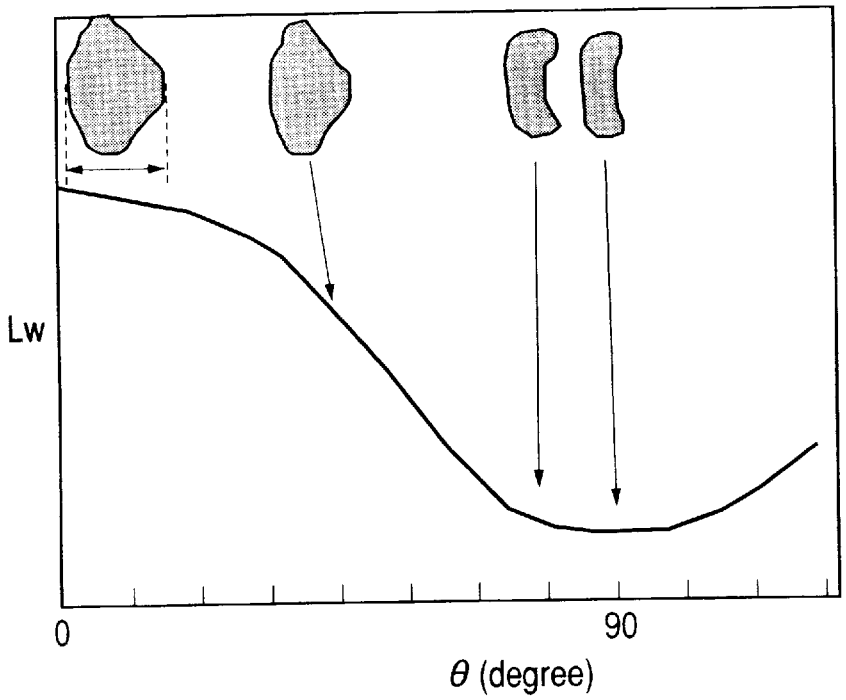
FIGS. 10A and 10B are graphs showing the inclination angle θ of the device according to the present invention.
Figure 10B:
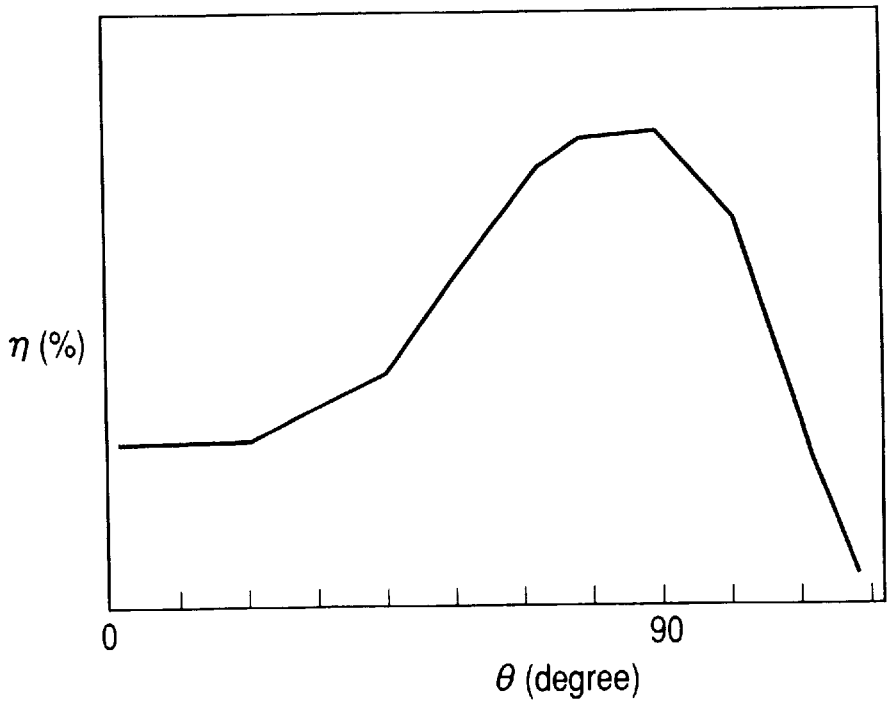

In addition, FIGS. 10A and 10B show beam diameters and efficiencies in various inclining angles. When inclining angles θ are less than 45 degrees, the electron beam diameter Lw rapidly decreases and the efficiency η also decreases. In addition, with θ larger than 100 degrees, the electron beam diameter Lw does not grow larger but the efficiency η rapidly decreases.

This indicates that in the case when the inclining angle θ is less than 45 degrees, changes does not solely occur in length but inclination itself will change the space potential and its characteristics do not depend on T1 or T3 but, that is, approach the prior art plane type. In addition, in the case when the inclining angle θ is larger than 100 degrees, the number of occurrence of scattering will only increase due to inclination.

Accordingly, the preferable application range is the inclining angle of not less than 45 degrees and not more than 100 degrees, and further preferably falls within 90 degrees ±10 degrees.

In the present invention, importance of the shape in the vicinity of the electron-emitting region was described, but of course, potential distribution covering a further wide range is also important as the range to be influenced by the electron trajectoies. As important factors as their parameters, there is distance from the electron-emitting region to the extreme end of the high potential side electro-conductive member (in the respective x and y directions) and from the electron-emitting region to low potential side electro-conductive member (in the respective x and y directions) together with its thickness (in the z direction) at the time of being seen from the anode electrode. In addition, in particular, distance in the x direction is important.

In the case where the thickness is uniform, as standard for the size of the potential region, the above described characteristic distance Xs will become reference. That is, the distance of not less than 15 times larger than the characteristic distance Xs in the both of x direction and y direction will be sufficient to obtain effects of the present embodiment. In addition, at least in the y direction, the distance of not less than 1.5 times, and hopefully not less than 5 times larger than the characteristic distance Xs can provide with high efficiency as well as highly accurate effects of the electron beam diameter with slight change in application range of the present embodiment.

The reason why sufficient length for the region length is necessary in the x direction is that the configuration according to the present embodiment has potential distribution largely influenced by the potential distribution in the x direction.

In the case where any change occurs in the direction of thickness, further caution is necessary, but determination in appropriate consideration of electron trajectoies will sufficiently enable to take advantage of the effects of the present invention.

As described so far, in the case of the configuration of the present invention, improvement in electron-emitting efficiency η is planned, and at the same time enhancement in high accuracy and minuteness on electron beam diameters can be planned as a result of convergence.

As a coefficient of electron beam diameter in the x direction, not less than 0.3 as Kw, and as a coefficient of the beam diameter in the y direction, not less than 0.6 as Kh are possible.

On the above described electron-emitting device of the present invention as well as electron-emitting apparatus as well as image forming apparatus using it will be described in detail, introducing further preferable embodiment as well as producing method.

Figure 11A:
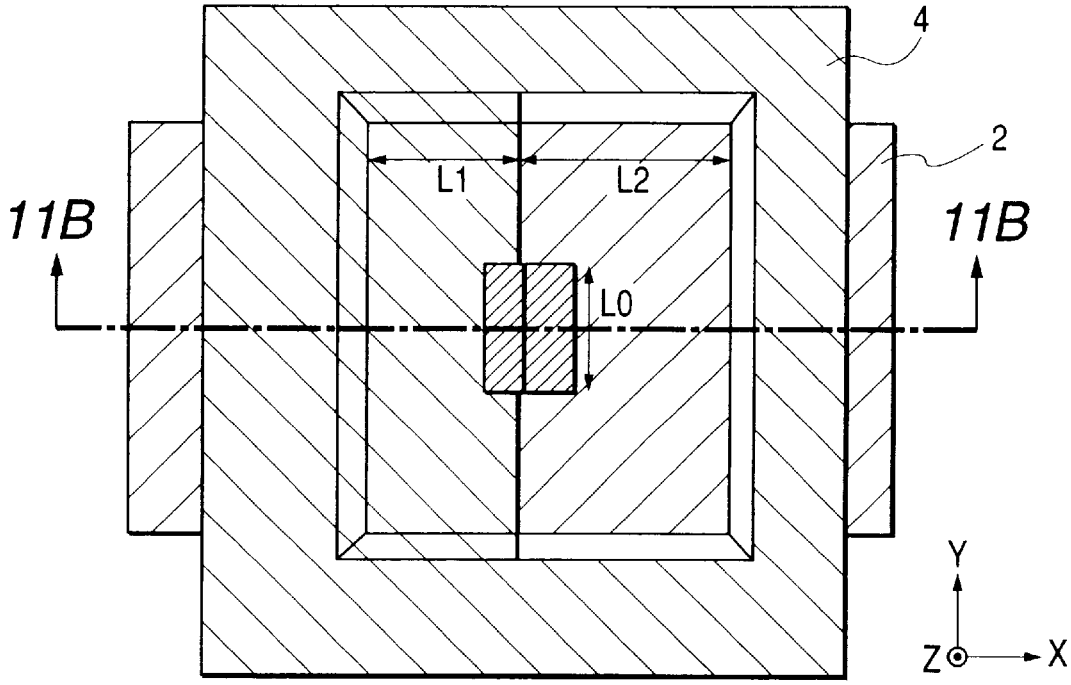
FIGS. 11A and 11B show the electron-emitting device according to the present invention.
Figure 11B:
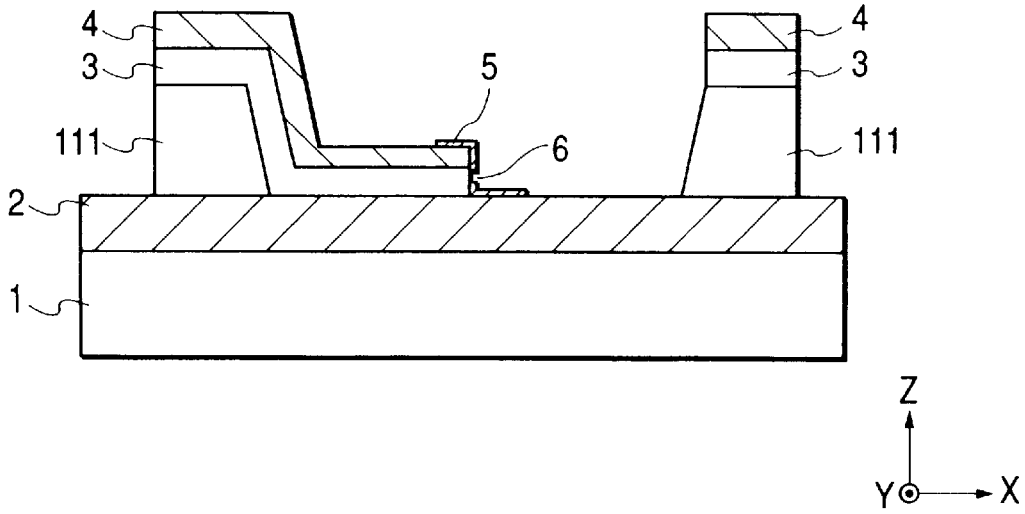
Figure 12:
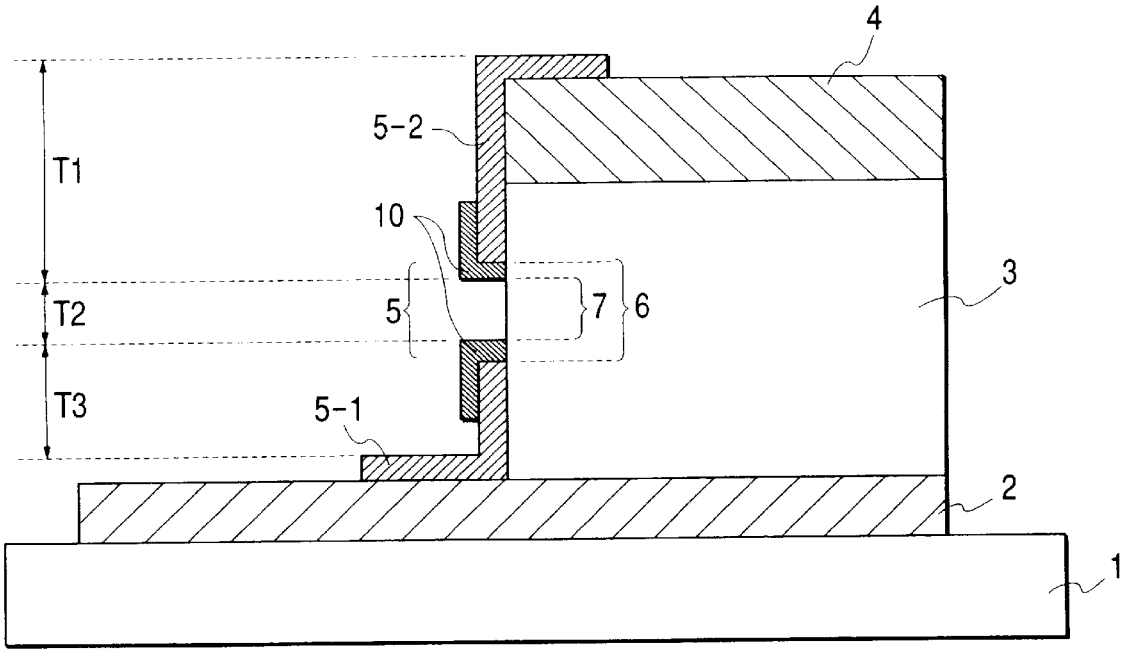
FIG. 12 shows the electron-emitting device according to the present invention.
Figure 13A:
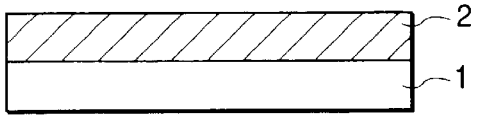
FIGS. 13A, 13B, 13C, 13D and 13E show a method of producing the electron-emitting device according to the present invention.
Figure 13B:
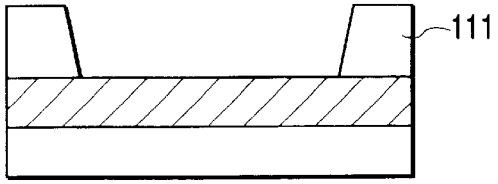
Figure 14:
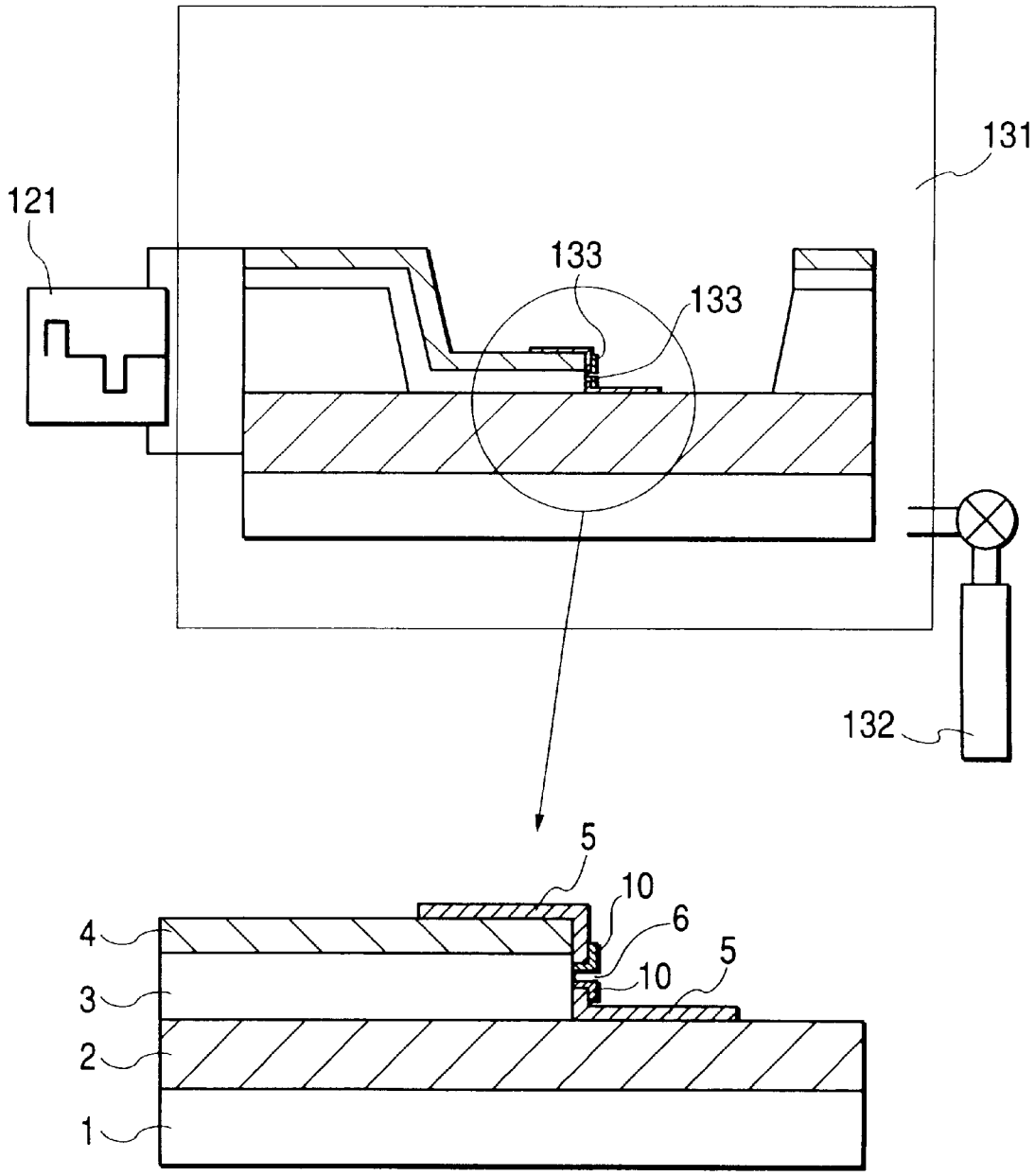
FIG. 14 shows the method of producing an activating operation of the electron-emitting device according to the present invention.

FIGS. 11A and 11B and FIG. 12 are model views showing an example of electron-emitting device of the present invention, and FIG. 11A is a plan view, FIG. 11B is a sectional view along a line 11B—11B of FIG. 11A, and FIG. 12 is a model view showing by enlarging the vicinity of the electron-emitting region of the device of FIGS. 11A and 11B. FIGS. 13A and 13B and FIG. 14 show an example of manufacturing method of the electron-emitting device of the present invention.

In FIGS. 11A and 11B the same reference numerals denote the same members as those in FIGS. 1A and 1B. Reference numeral 1 denotes a substrate, reference numeral 2 denotes a low potential electrode, reference numeral 3 denotes an insulating layer, reference numeral 4 denotes a high potential electrode, reference numeral 5 denotes an electro-conductive film, and reference numeral 6 denotes a gap.

Reference numeral 111 denotes a second insulating layer, and there is a case where, when the high potential electrode 4 as a wiring extending in the X direction and the low potential electrode 2 as a wiring extending in the Y direction are respectively formed into a matrix shape, it is laminated in order to reduce capacity of their intersection.

As shown in FIGS. 11A and 11B, the device has length of L0 in the y direction. In addition, in the x direction, the device has high potential electrode width of L1 and low potential electrode width of L2 that are extended from the electron-emitting region (the side wall of the insulating layer 3) in the perpendicular direction.

The high potential electrode width of L1 and the low potential electrode width of L2 require lengths not less than a fixed length in order to obtain the effects of the present invention as described above.

For example, with Vf being driving voltage, Va being anode voltage, and H being distance between the device and anode electrode 8, its characteristic distance is $Xs=(H\times Vf)/(\pi\times Va)$, and it is necessary to use an electrode having width of not less than 15 times larger than the characteristic distance Xs.

As a substrate 1, silica glass, a glass in which impurity content such as Na, etc. is caused to decrease and a portion is replaced with K, etc., a laminated body in which $SiO_2$ has been laminated with soda lime glass as well as silicon substrate, etc. by way of spattering method, etc., an ceramic insulating substrate such as almina, etc. are nominated subject to sufficient cleaning on the surface thereof.

The low potential electrode 2 generally has electro-conductivity, and is formed with general film forming technology such as a vacuum evaporation method and spattering method, etc. as well as photolithography technology.

Materials for electrodes are appropriately selected from metals such as Be, Mg, Ti, Zr, Hf, V, Nb, Ta, Mo, W, Al, Cu, Ni, Cr, Au, Pt, Pd, etc., alloy materials or the same materials as an electro-conductive film 5 to be described later. Thickness of the above described low potential electrode 2 is set within a range of several tens nm to several mm, and preferably is selected within a range of several tens nm to several hundreds $\mu$m.

The insulating layer 3 is formed with general film forming technology such as a spattering method, a thermal oxidation method, and anodic oxidation method, etc. and its thickness is set within a range of several nm to several tens $\mu$m, and preferably is selected within a range of several tens nm to several $\mu$m. As desirable materials, highly heat-resistant materials such as $SiO_2$, SiN, $Al_2O_3$, and CaF, etc. that can tolerate against a high electric field are desirable.

A high potential electrode 4 may be the same material as a low potential electrode 2 or a different kind of material unlike it, but preferably, a heat-resistant material (materials having higher melting point than that of the low potential electrode) is desirable. In addition, its thickness will become an important parameter to obtain an effect in addition to the gap position. Accordingly it is set within a range of several nm and several hundreds nm. In addition, in some cases, it could serve as an electro-conductive film 5 to be described later.

The electro-conductive film 5 is formed with general film forming technology such as a vacuum evaporation method and spattering method, etc.

Materials to be used in the electro-conductive film 5 are metals such as Pd, Ru, Ag, Au, Ti, In, Cu, Cr, Fe, Zn, Sn, Ta, W, Pt, etc. as well as their alloys, oxides such as PdO, $SnO_2$, $In_2O_3$, PbO, and $Sb_2O_3$, etc., borides such as $HfB_2$, $ZrB_2$, $LaB_6$, $CeB_6$, $YB_4$, $GdB_4$, etc., carbides such as TiC, ZrC, HfC, TaC, SiC, WC, etc., nitrides such as TiN, ZrN, HfN, etc., semiconductors such as Si and Ge, etc., and carbon, etc. Its resistant value shows a sheet resistant value of $10^3$ to $10^7$ $\Omega/\square$.

In order to produce the gap 6 to the electro-conductive film 5, a technique called "forming operation", for example, is used. "Forming operation" is a step of forming a gap in a portion of a electro-conductive film with Joule heat generated by causing a current to flow in the electro-conductive film.

In the case where the later-described "activation step" is not implemented, a work function ($\phi$wk) of the electro-conductive film 5 will become important.

Moreover, the device completing "forming operation" is brought into "activation step," resulting in the case where a film (a carbon film) 10, having carbon is formed on the insulating layer 3 as well as the electro-conductive film 5 inside the gap 6 as shown in FIG. 12.

The above described carbon film 10 is an electro-conductive film including, for example, graphite (include so-called HOP, PG or GC, while HOPG means a nearly complete graphite crystal configuration, PG means crystal grain sized around 20 nm having slightly irregular crystal configuration, GC means referred to a crystal grain sized around 2 nm having larger irregular crystal configuration) and amorphous carbon (that refers to amorphous carbon as well as mixture of amorphous carbon and minute crystal of the above described graphite).

In the case where the carbon film 10 is coated with the present step, length of the carbon film 10 in the direction where the electro-conductive film 5-1 and the electro-conductive film 5-2 shown in FIG. 12 are facing is added to T1 and T3. In addition, as for film thickness, comparatively thinner carbon film 10 is better, and the range of several nm to not more than several tens nm is preferable.

This serves to form a gap 7 narrow than the gap 6 as shown in FIG. 12 with the above described activation step. Length of this gap 7 will be T2.

Incidentally, here, a carbon film was adopted as the film 10 to be formed with the activation step but in the present invention a film made of another electro-conductive material may be adopted.

In addition, for the device having undergone the activation step, in addition to the above described first electro-conductive film 5-1 and the electrode 2, the carbon film 10 brought into connection with the electro-conductive film 5-1 will be inclusively called as a low potential side electro-conductive member. In addition, likewise, for the device having undergone the activation step, in addition to the above described second electro-conductive film 5-2 and the electrode 4, the carbon film 10 brought into connection with the electro-conductive film 5-2 will be inclusively called as a high potential side electro-conductive member.

In the case where the activation step has formed a member different from the electro-conductive film 5 in the vicinity of the gap 6 and in its periphery, its work function ϕwk will be a parameter in the present embodiment and be important.

Normally, to the work function ϕwk of a high potential side electro-conductive member in the case of device having undergone activation step, ϕwk=5 eV being the work function of carbon is applied. In the case of device not having undergone any activation step, the work function of the material of the high potential side electro-conductive film 5-2 is applied.

Next, a manufacturing step of electron-emitting device having shown in FIGS. 11A and 11B will be described with reference to FIGS. 13A to 13E and FIG. 14.

(1) Material of the low potential electrode 2 is deposited on the surface (first main surface) of the insulating substrate 1 so that the sediment gets etched into a preferable shape with an appropriate method such as photo-lithography, etc. to form a low potential electrode 2 (FIG. 13A).

(2) Material for an inter-layer insulating layer 111 to become a second insulating layer is deposited so that the sediment gets etched into a preferable shape with an appropriate method such as photo-lithography, etc. to expose the low potential electrode 2 to form an inter-layer insulating layer 111 (FIG. 13B).

Figure 13C:
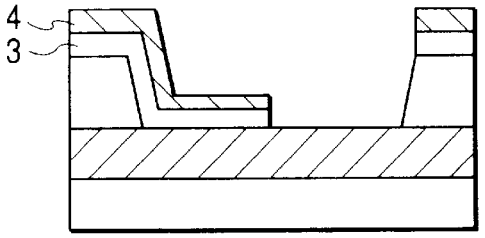

(3) Material for the insulating layer 3 as well as material for the high potential electrode 4 are deposited so that the sediment gets etched into a preferable shape with an appropriate method such as photo-lithography, etc. to expose the low potential electrode 2 to produce an insulating layer 3 as well as the high potential electrode 4 (FIG. 13C).

As technique to form the high potential electrode 4, spin coating of photoresist and exposure as well as developing of mask pattern are implemented so that a portion of the insulating layer 3 as well as the high potential electrode 4 is removed with wet etching or dry etching. For the etching step, plane and smooth as well as perpendicular etching surface is preferable, and the etching method may be selected according to materials respectively for the electrode and the insulating layer.

Figure 13D:
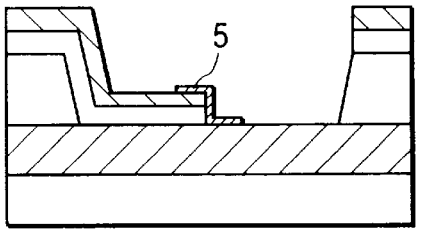

(4) Next, the material for the electro-conductive film 5 is deposited and the sediment is formed into a preferable shape with an appropriate method such as photolithography, etc. (FIG. 13D).

Figure 13E:
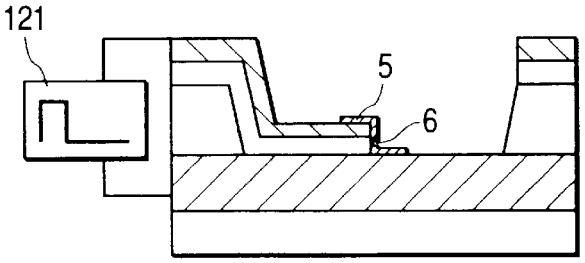

(5) Moreover, with the above described "forming operation" a gap 6 is produced in a portion of the electro-conductive film (FIG. 13E).

As an example of forming step, there is a method to produce the gap 6 in one portion of the electro-conductive film 5 by applying voltages between the low potential electrode 2 and the high potential electrode 4 with the pulse generator 121. This forming step causes the electro-conductive film to be separated as shown in FIG. 12, etc. into the electro-conductive film 5-2 brought into electrical connection with the high potential electrode 4 and the electro-conductive film 5-1 brought into electrical connection with the low potential electrode 2.

(6) Moreover, the activation step is performed. Its example is shown in FIG. 14. The activation step is, for example, performed under an atmosphere containing carbon compound gas by repeating application of pulse voltage of bipolarity so as to form the carbon film 10 as shown in FIG. 12. Forming region of the carbon film depends on size of each member and also on voltage values to be applied in the activation step, and as show in FIG. 26 for example, can be formed so as to cover almost all the electro-conductive film.

The above described atmosphere of carbon compound can be formed by use of organic gas remaining inside the atmosphere in the case where the interior of the vacuum container 131 is evacuated by use of for example diffusion pump or rotary pump, etc., and otherwise, can be also obtained by introducing appropriate organic substance 132 in the vacuum space that is once sufficiently evacuated with an ion pump, etc.

Preferable gas pressure of the organic substance 132 at this time depends on shape of the vacuum container 131 and kind, etc. of the organic substance 132 and therefore is set appropriately according to each case.

As suitable organic substances 132, alkane, alkene, aliphatic hydrocarbons of alkane, aromatic hydrocarbon, alcohols, aldehydes, ketones, amines, organic acids, etc. such as nitriles, phenols, carvone, sulfonic acid can be nominated, and, in particular, methane, ethane, propane, etc. or saturated hydrocarbon expressed by $C_nH_{2n+2}$, ethylene, propylene, etc. or unsaturated hydrocarbon expressed by composition formula of $C_nH_{2n}$, etc., benzene, toluene, methanol, ethanol, formaldehyde, acetaldehyde, acetone, methyl ethyl ketone, methylamine, ethylamine, phenol, benzonitriles, acetonitriles, formic acid, acetic acid, propionic acid, etc. can be used. This operation causes carbon or carbon compounds to be deposited for lamination and coating as the sediment 133 from organic substance 132 existing in the atmosphere on the device.

This activation step forms a carbon film 10 on the insulating layer 3 inside the gap 6 formed in the electro-conductive film 5 as well as the electro-conductive film (5-1 and 5-2) as shown in FIG. 12. In addition, at the same time, a gap 7 narrower than the gap 6 is formed by the carbon film 10.

The above described step forms the electron-emitting device of the present invention.

Next, application examples of the electron-emitting device of the present invention will be described as follows. It is possible to arrange a plurality of the electron-emitting devices on the substrate to configure for example an electron source or an image-forming apparatus.

Various kinds of arrangement for electron-emitting device are adopted. As an example, one involves a ladder-shaped disposition wherein a number of electron-emitting devices disposed in parallel are respectively connected at both ends each other and a number of lines of electron-emitting devices are disposed (called a row direction), and to the direction perpendicular with this wiring (called column direction) the controlling electrode (also called a grid) disposed upper the electron-emitting devices controls and drives electrons from the electron-emitting devices.

Other than this, nominated is the one wherein a plurality of electron-emitting devices are disposed in the x direction and the y direction in a matrix shape, and one party of electrodes of a plurality of electron-emitting devices disposed in the same row are commonly connected to the wiring of the x direction, and the other party of electrodes of a plurality of electron-emitting devices disposed in the same column are commonly connected to the wiring of the y direction. The one like this is so called matrix formation.

Figure 15:
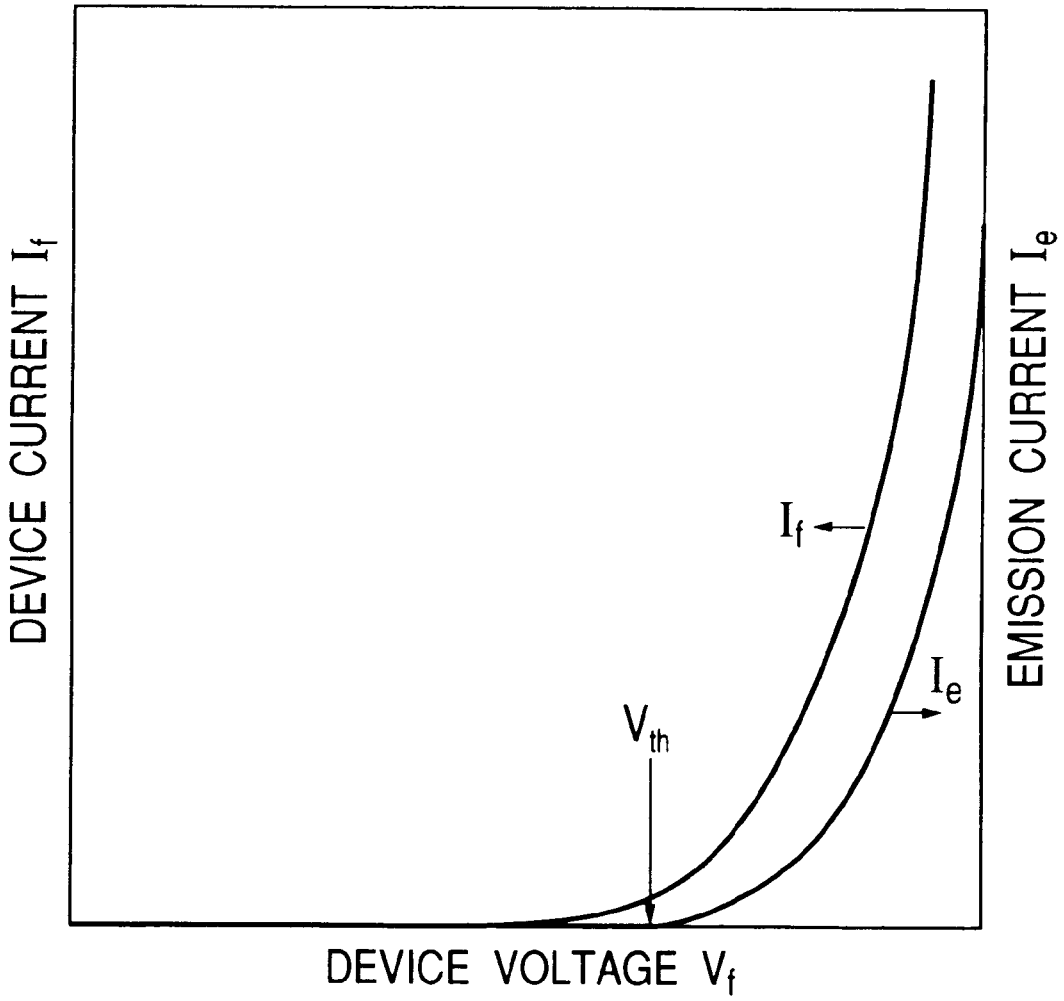
FIG. 15 is a graph of a V-I characteristic of the electron-emitting device according to the present invention.

At first, the simple matrix formation will be described in detail as follows. FIG. 15 shows characteristic of the electron-emitting device of the present invention. The emission electrons from the electron-emitting device can be controlled with the wave height value and width of the pulse-shaped voltage applied between the electrodes for a voltage not less than the threshold voltage Vth. On the other hand, for a voltage not more than the threshold voltage Vth, emission will scarcely take place.

According to this feature, also in the case where a number of electron-emitting devices are disposed, appropriate application of pulse-shaped voltage to respective devices can control the quantity of electron emission by selecting the electron-emitting devices in accordance with the input signals.

Figure 16:
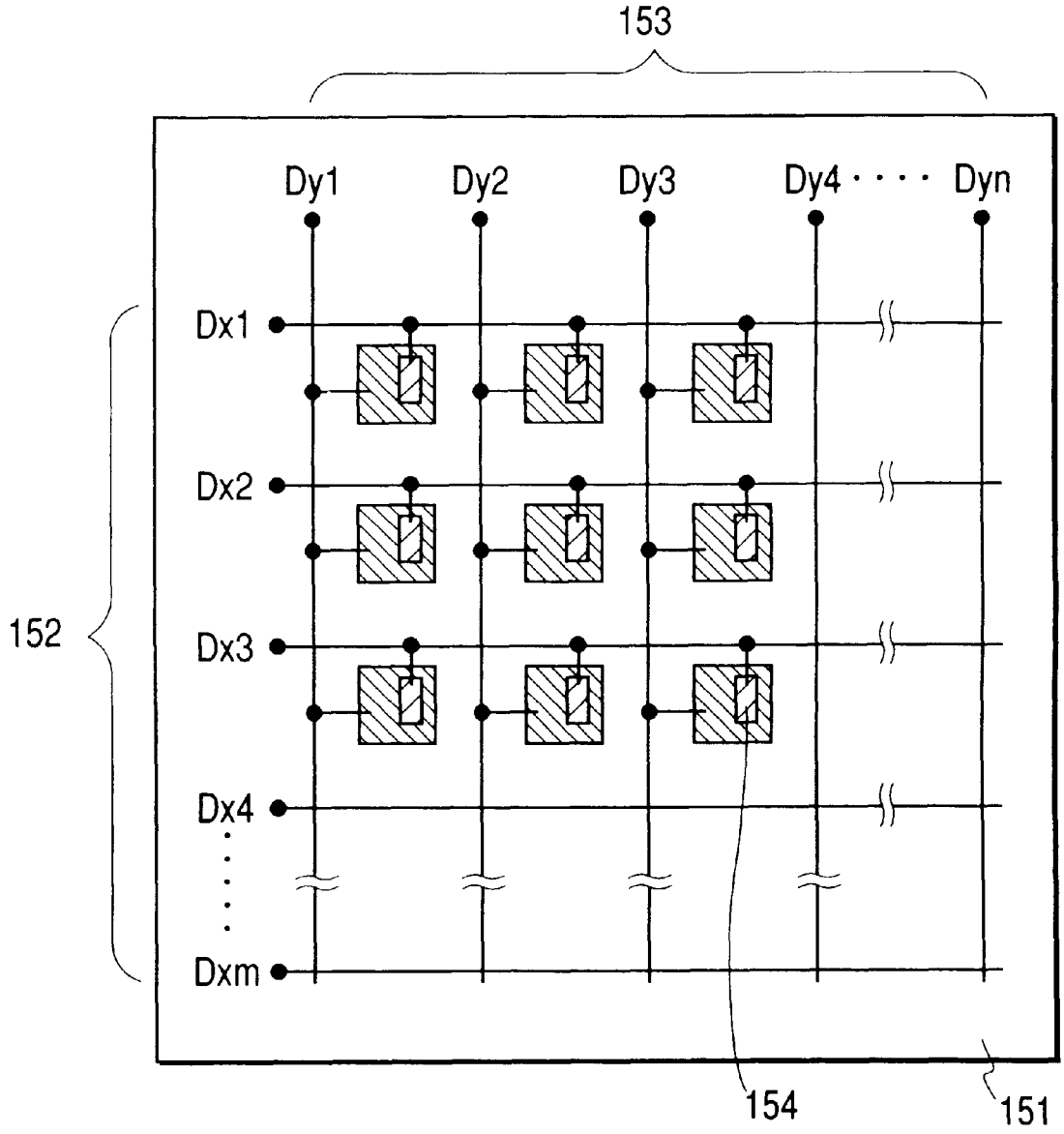
FIG. 16 shows a configuration of a matrix of an electron source according to the present invention.

Based on this principle, an electron source obtainable by disposing a plurality of electron-emitting devices to which the present invention is applicable will be described as follows using FIG. 16. In FIG. 16, reference numeral 151 denotes a electron source substrate, reference numeral 152 denotes wiring in the x direction, and reference numeral 153 denotes wiring in the y direction. Reference numeral 154 denotes the electron-emitting device of the present invention, and reference numeral 155 denotes wiring knot.

X direction wiring 152 in m units consists of Dx1, Dx2, . . . , Dxm, and can be configured by conductive metal formed by using vacuum evaporation method, printing method, and sputtering method, etc. or the like. Materials for wiring, film thickness, and width are appropriately designed. Y direction wiring 153 consists of wiring of n units, namely Dy1, Dy2, . . . , and Dyn, and is formed similarly to x direction wiring 152. Not-shown inter-layer insulation layer is provided between these m units of x direction wiring 152 and n units of y direction wiring 153 to electrically separate the both parties (m and n are both positive integers).

The not-shown inter-layer insulation layer is configured by $SiO_2$ formed by using vacuum evaporation method, printing method, and sputtering method, etc. or the like. For example, the layer is formed into a desired shape on the entire surface or on a portion of the substrate 151 having formed x direction wiring 152, and film thickness, material, and, producing method are appropriately set so that especially the layer can tolerate the potential at the intersection between x direction wiring 152 and y direction wiring 153.

X direction wiring 152 and y direction wiring 153 have been respectively pulled out as external terminals. A pair of electrodes (not shown) configuring the electron-emitting device 154 are electrically connected with m units of x direction wiring 152 and n units of y direction wiring 153.

As for materials configuring wiring 152 and wiring 153, materials configuring wiring knot 155, and materials configuring a pair of device electrodes, a part or the whole of the component elements thereof may be common or may be respectively different. These materials are appropriately selected from for example materials of the above described electrode. In the case where materials configuring the device electrode and materials of wiring are the same, wiring connected with an element electrode can be called as a device electrode.

X direction wiring 152 is connected with the not shown scanning signal application means which applies the scanning signal to select lines of electron-emitting devices 154 arranged in the X direction. On the other hand, y direction wiring 153 is connected with not-shown modulated signal generating means to modulate each column of the electron-emitting devices 154 arranged in the y direction in accordance with the input signals. The driving voltage which is applied to each electron-emitting device is supplied as differential voltage between the scanning signal and the modulated signal to be applied to the said device 154.

In the above-described configuration, simple matrix wiring is used to enable respective elements to be selected independently and to drive independently.

An image-forming apparatus that has been configured by using such an electron source in the above-mentioned simple matrix formation will be described with reference to FIG. 17.

Figure 17:
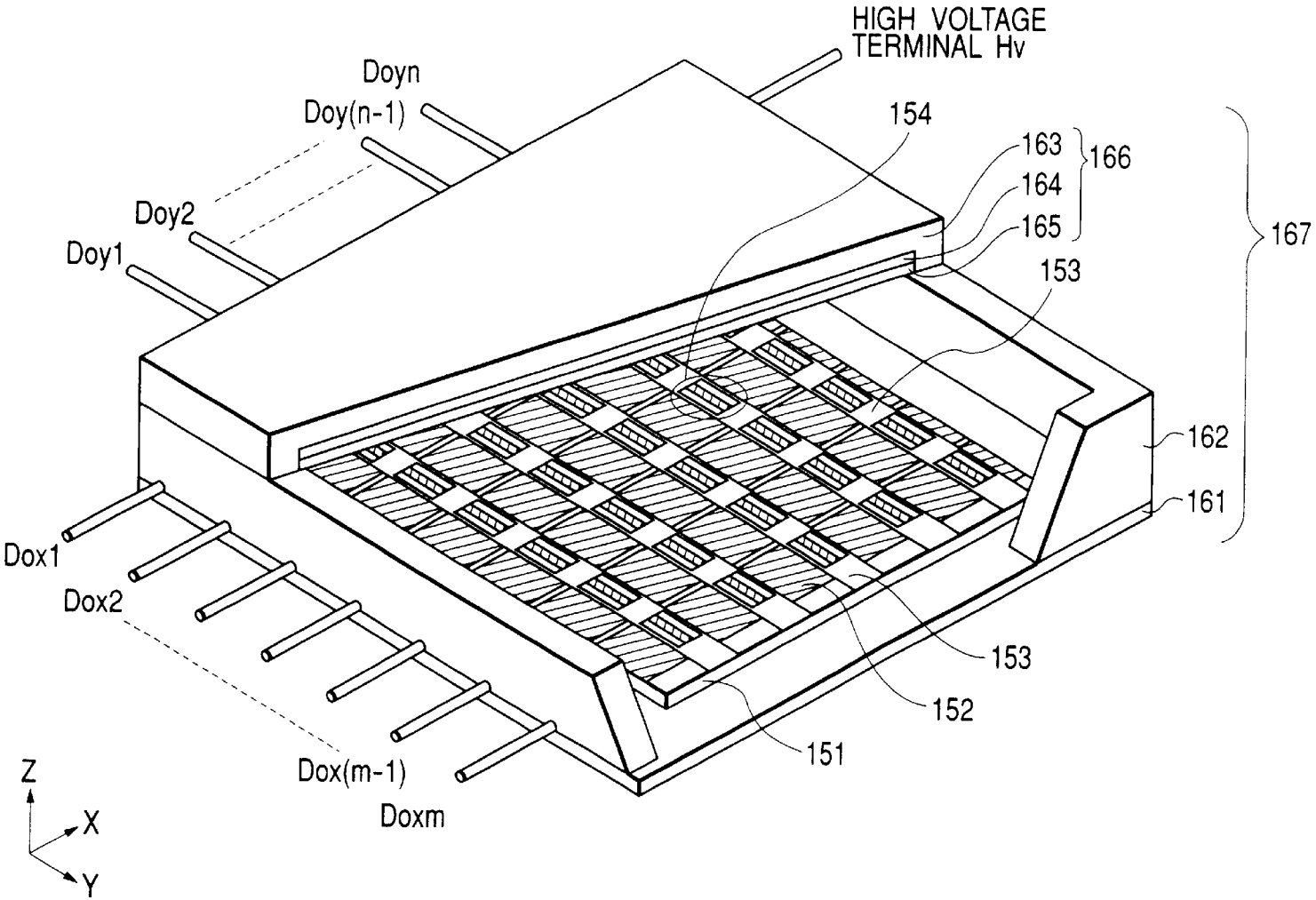
FIG. 17 shows an outline of a configuration of a display panel of an image-forming apparatus.

FIG. 17 is a model view showing one example of the display panel of an image-forming apparatus, and reference numeral 151 denotes an electron source substrate in which plurality of electron-emitting devices are disposed, reference numeral 161 denotes a rear plate on which the electron source substrate 151 is fixed, and reference numeral 166 denotes the face plate in which fluorescent film 164 and metal back 165, etc. are formed inside the glass substrate 163.

Reference numeral 162 denotes a supporting frame and to the supporting frame 162 a rear plate 161 and a face plate 166 undergo junction using flit glass or the like.

The envelope 167 is configured by being baked for not less than 10 minutes under the temperature of 400 to 500 degrees, for example, the atmosphere, vacuum space, or nitrogen and being sealed. The envelope 167 is configured by comprising a face late 166, a supporting 162 and a rear plate 161 as described above.

Since the rear plate 161 is provided mainly for the purpose of reinforcing strength of the electron source substrate 151, and thus when the electron source substrate 151 itself has sufficient strength, a rear plate 161 as a separate body can be regarded unnecessary. That is, the supporting frame 162 is directly sealed to the substrate 151 so that the envelope 167 may be configured with the face plate 166, the supporting frame 162 and the substrate 151.

On the other hand, a not-shown supporting body called a spacer can be disposed between the face plate 166 and the rear plate 161 to configure the envelope 167 with sufficient strength against the atmosphere pressure.

Figure 18A:
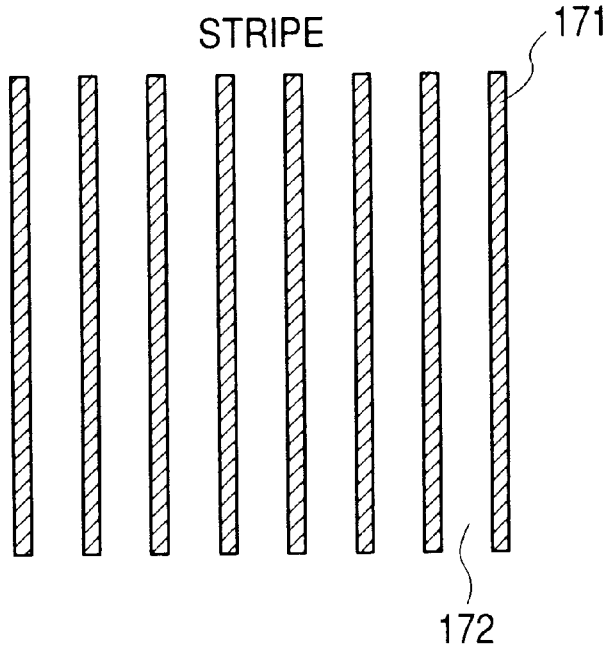
FIGS. 18A and 18B show an embodiment of a phosphor.
Figure 18B:
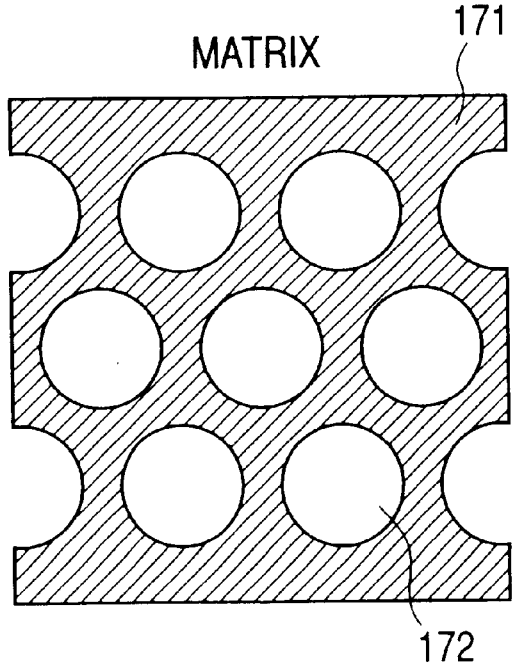

FIGS. 18A and 18B show an example of the face plate 166. FIG. 18A shows a stripe configuration and (b) shows a matrix configuration.

The image-forming apparatus of the present invention will be able to display highly minute images, and therefore, a mode of these arrangements and pitches can be selected. In addition, in the electron-emitting device of the present invention, the electron beam diameter in the x direction in particular can be made small, and therefore provides with an advantageous configuration for the stripe configuration shown in FIG. 18A.

The face plate 166 is configured by comprising a phosphor 172 and a black member 171. As materials for the black member 171 and the phosphor 172, those available in market in general can be used.

However, in general, even in the case where the beam diameter of the electron beam is made small in the electron-emitting device, the phosphor will implement transform to give rise to a further wider light beam in addition thereto. Accordingly, in the case where highly minute display is planed, as the phosphor, the materials as well as the film thickness need to be selected appropriately in consideration of beam widening.

Distance between the face plate 166 and the rear plate 161 is held at a constant distance H with the supporting frame 162 or the (not shown) spacer. As the distance H for the plane type display apparatus, several $\mu$m to several mm is generally selected.

That distance H is a equation on reaching position in the case where the beam from the electron-emitting device reaches the phosphor as well as electron beam diameter as shown in the above described equations (3a) and (3b), and smaller H will make more highly minute beam diameter obtainable. However, small H will give rise to difficulty in holding the vacuum state, and therefore will not be appropriate for a large size image-forming apparatus.

On the other hand, the equations (3a) and (3b) are complete for Va>>Vf, and for the image-forming apparatus, a value of not less than 1 kV and not more than 30 kV is selected as Va.

However, when H is made small and Va is made high, discharge will be apt to occur, and therefore consideration will be required for its producing method. Accordingly, in the present embodiment, as a preferable range, H is selected to fall within the range of not less than 0.1 mm and not more than 5 mm while Va is selected to fall within the range of not less than 1 kV and not more than 20 kV.

Figure 19:
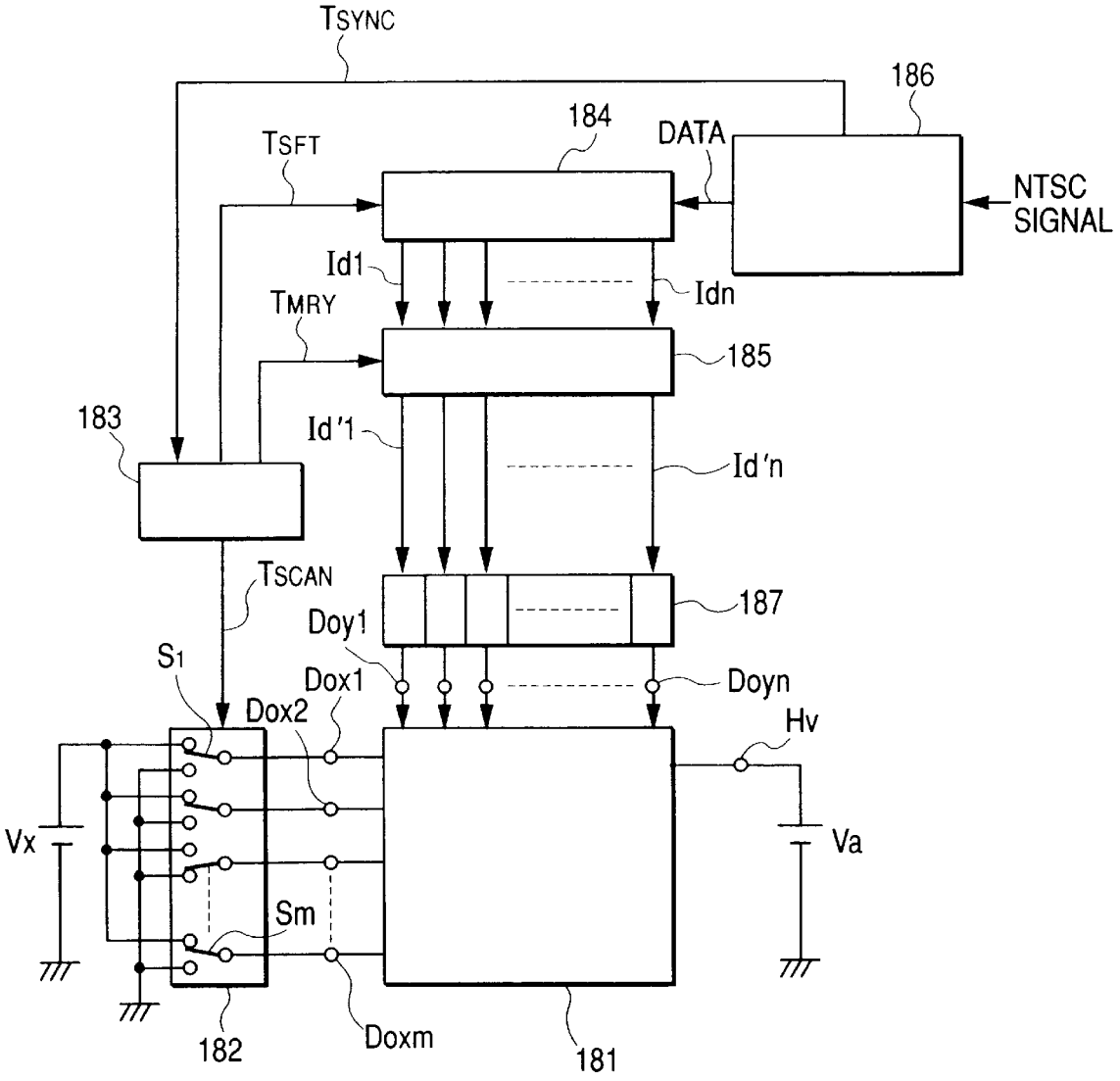
FIG. 19 shows an outline of a configuration of a drive circuit of an image-forming apparatus.

Next, using FIG. 19, described will be a configuration example of driving circuit to implement television display based on television signals of the NTSC system onto the display panel configured using the electron source of the simple matrix disposition.

In FIG. 19, reference numeral 181 denotes an image display panel, reference numeral 182 denotes a scanning circuit, reference numeral 183 denotes a controlling circuit, and reference numeral 184 denotes a shift register. Reference numeral 185 denotes a line memory, reference numeral 186 denotes a synchronizing signal separation circuit, reference numeral 187 denotes a modulation signal generating circuit, and reference characters Vx and Va denote direct voltage source.

The image display panel 181 is connected with an outside electric circuit via the terminals Doxl through Doxm, the terminals Doyl through Doyn, and the high voltage terminal Hv.

Applied to the terminals Doxl through Doxm is the scanning signal for sequentially driving the electron source provided in the image display panel 181, or a group of surface conduction electron-emitting devices that are matrix-wired in a shape of lines and columns with m lines and n columns line by line (on n devices).

Applied to the terminals Doyl through Doyn is a modulation signal for controlling the output electron beams from each device of a line of surface conduction electron-emitting devices selected by the aforementioned scanning signal.

Supplied to the high voltage terminal Hv is a direct voltage of such as 10 k[V] from the direct voltage source Va, and this is an acceleration voltage to give to the electron beam to be emitted from the surface conductive electron-emitting device the sufficient energy to excite the phosphor.

The scanning circuit 182 will be described. The said circuit comprises m units of switching elements inside itself (which are shown as a model with S1 through Sm in the drawing).

Each switching device selects either of the output voltage of the direct voltage source Vx or 0 [V] (the ground level), and is electrically connected with the terminals Dox1 thorough Doxm of the display panel 181.

Each switching device of S1 through Sm is to operate based on the controlling signal TSCAN which the controlling circuit 183 outputs, and can be configured by combining switching devices such as FET for example.

In this example, based on the features of the surface conductive electron-emitting device (electron emission threshold voltage), the direct voltage source Vx is set to output such a constant voltage that the driving voltage to be applied to the devices not yet scanned will be not more than the electron emission threshold voltage.

The controlling circuit 183 has a function to implement matching among each portions so that appropriate display may be implemented based on the image signal inputted from outside. Based on the synchronization signal TSYNC to be sent from the synchronization signal separation circuit 186, the controlling circuit 183 generates controlling signals respectively of TSCAN, TSFT and TMRY to each portion.

The synchronization signal separation circuit 186 is a circuit to separate the synchronization signal component and the brightness signal component from the television signals of the NTSC system to be inputted from outside, and can be configured by using a frequency separation (filter) circuit in general or the like.

The synchronization signals separated by the synchronization signal separation circuit 186 comprise vertical synchronization signals and horizontal synchronization signals, and here for the descriptive convenience have been illustrated as TSYNC signals. The image brightness signal component separated from the aforementioned television signals has been represented as DATA signal for the purpose of convenience. The DATA signal is inputted to the shift register 184.

The shift register 184 is to proceed with serial/parallel-converting on a line-by-line basis on images the above described DATA signals which are inputted chronologically, and to operate based on the controlling signals TSFT to be sent by the above described controlling circuit 183 (that is, the controlling signals TSFT can be referred to as a shift clock of the shift register 184).

The data for a line of serial/parallel-converted image (equivalent to driving data for n-unit elements of the electron-emitting devices) is outputted from the above described shift register 184 as n-unit parallel signals of Id1 through Idn.

The line memory 185 is a memory device to memorize the data for a line of image for a necessary time period, and memorizes contents of Id1 through Idn appropriately in accordance with the controlling signals TMRY to be sent from the controlling circuit 183. The stored contents are outputted as I'd1 through I'dn, and inputted to the modulation signal generating device 187.

The modulation signal generator 187 is a signal source to appropriately drive and modulate each of the surface conduction electron-emitting device in accordance with each of the image data Id'l through Id'n, and its output signals are applied to the surface conduction electron-emitting device in the image display panel 181 through the terminals Doyl through Doyn.

As described above, the electron-emitting device of the present embodiment has the following basic features toward the emission current Ie. That is, there is a clear threshold voltage Vth for electron emission, and only when a voltage not less than the threshold voltage, electron emission takes place. For a voltage not less than the threshold voltage, emission current changes in accordance with changes of voltage applied to the elements.

Based on this, when pulse-shaped voltage is applied to the present elements, for example, a voltage not more than the electron emission threshold value, electron emission does not take place, but when a voltage not less than the electron emission threshold value is applied, an electron beam is outputted. In that case, changes in the wave height value of the pulses Vm enable to control intensity of the output electron beams. In addition, changes in the pulse width Pw enable to control total quantity of charges of the outputted electron beams.

Accordingly, as the system to modulate the electron-emitting device in accordance with the input signals, a voltage modulation system, pulse width modulation system, etc. can be adopted. At the time when the voltage modulation system is implemented, as the modulation signal generator 187, such a circuit of voltage modulation system that generates voltage pulses with a constant length and modulates the wave height value of the pulses appropriately in accordance with the inputted data can be used.

At the time when the pulse width modulation system is implemented, as the modulation signal generator 187, such a circuit of pulse width modulation system that generates voltage pulses with a constant wave height value and modulates the voltage pulse width appropriately in accordance with the inputted data can be used.

As for the shift register 184 or the line memory 185, both of digital signal system and analog signal system can be adopted. The reason is that it is enough if the serial/parallel conversion and memorization on image signals is implemented at a predetermined speed.

In the case where the digital signal system is used, it is necessary to code the output signals DATA of the synchronization signal separation circuit 186 into digital signals, and an A/D converter is well equipped in the output portion of the synchronization signal separation circuit 186 for this purposes.

In this relation, the circuit to be used for the modulation signal generator 187 will become slightly different based on whether the output signals of the line memory 185 are digital signals or analog signals. That is, in the case of voltage modulation system using digital signals, D/A conversion circuit for example is used as the modulation signal generator 187, and an amplifying circuit, etc. are attached thereto in accordance with necessity.

In the case of the pulse width modulation system, as the modulation signal generator 187, used is a circuit combining for example a high speed oscillator, a counter to count waves outputted from the oscillator, and a comparator to compare the output value of the counter and the output value of the above described memory.

In accordance with necessity, an amplifier can be added so that the modulation signals, which have undergone pulse width modulation, to be outputted from the comparator are voltage-amplified to reach the driving voltage of the surface conduction electron-emitting device.

In the case of the voltage modulation system using analog signals, as the modulation signal generator 187, for example an amplifying circuit using operational amplifier can be adopted, and in accordance with necessity, a level shift circuit, etc. can be added thereto.

In the case of pulse width modulation system, for example a voltage control type oscillation circuit (VOC) can be adopted, and in accordance with necessity, an amplifier can be added so that the voltage is amplified to reach the driving voltage of the surface conduction electron-emitting device.

In an image display device of the present embodiment (FIG. 17) that can take such configurations, electron emission takes place by applying voltage to each electron-emitting device via the terminals outside the container consisting of Dox1 through Doxm and Doy1 through Doym. High voltage is applied to the metal back 165 or transparent electrode (not shown) via the high voltage terminal Hv so as to accelerate the electron beam. The accelerated electrons strike the fluorescent film 164 so as to cause radiation and form images.

The configuration of image forming device having been described herein are one example of image forming device, and based on the technological philosophy of the present invention, various variants are possible. As concerns the input signals, the NTSC system has been nominated, but the input signals are not limited hereto, and in addition to PAL, ad SECAM system, etc., TV signal systems (for example, high definition TV such as MUSE system, etc.) consisting of more numerous scanning lines can be adopted.

The image-forming apparatus of the present invention can be used for television broadcast, and display device for television conference system, and computers, etc. and in addition, as the image forming apparatus as optical printer configured using light-sensitive drum, etc.

[Embodiments]

Embodiments of the present invention will be described in detail as follows.

[Embodiment 1]

With reference to FIGS. 11A and 11B, FIG. 26, FIGS. 13A to 13E, and FIG. 14, an electron-emitting device that was produced in the present embodiment will be described.

(Step 1)

A silica substrate is used for a substrate 1, and subject to sufficient cleaning, Al of thickness of 500 nm was deposited as a low potential electrode 2 with sputtering method.

Next, a resist pattern was formed by using positive photoresist (AZ1500/produced by Clariant K.K.) during a photolithography step.

Next, with the above described photoresist subject to patterning as a mask, the Al layer was dry-etched with chlorines such as $BC_3$, etc. to form the low potential electrode 2 (FIG. 13A).

(Step 2)

With rf sputtering method, $SiO_2$ of thickness of 500 nm was deposited as an inter-layer insulating layer 111. Next, a resist pattern was formed by using positive photoresist (AZ1500/produced by Clariant K.K.) during a photolithography step. Next, with the above described photoresist subject to patterning as a mask, the inter-layer insulating layer 111 was wet-etched with fluorooxides to be caused to halt on the upper surface of the low potential electrode 2 (FIG. 13B).

The inter-layer insulating layer having width of 20 $\mu$m was formed so as to enclose the periphery of the device portion as in FIG. 11A. The sectional view of the inter-layer insulating layer was arranged to have a moderate inclination to prevent film break due to the step portion of the later-described insulating layer 3 in Step 3 as well as the inter-layer insulating layer 111 of the high potential electrode 4.

(Step 3)

$SiO_2$ of thickness of 40 nm was deposited as insulating layer 3 and Ta of thickness of 5 nm as high potential electrode 4.

Next, a resist pattern was formed using positive photoresist (AZ1500/produced by Clariant K.K.) during a photolithography step.

Next, with the above described photoresist subject to patterning as a mask, the high potential electrode 4 as well as the insulating layer 3 were etched with RIE. $CF_4$ gas was selected as etching gas.

In addition, other conditions at dry-etching depend on size, configuration, and substrate size, and in the present embodiment, pressure of 2.7 Pa and discharge power of 1000 W were used. Utilizing the etching selection rate between the insulating layer 3 and the low potential electrode 2 at this time being not less than two, etching was halted with the low potential electrode 2 (FIG. 13C).

Width of electrode produced during steps so far, L1=30 μm, and L2=30 μm as shown in FIGS. 11A and 11B. In addition, opening width of the low potential electrode in the y direction was set at 200 μm.

(Step 4)

Next, with photolithography technology, an opening was formed in the photo resist.

Next, Pd film of thickness 4 nm as electro-conductive film 5 was deposited. Thereafter, the photo resist was delaminated so that the electro-conductive film 5 was formed with a lift-off method in the center portion of the device over the high potential electrode and the low potential electrode (FIG. 13D). Length L0 of the electro-conductive film 5 in FIGS. 11A and 11B was set at 50 μm.

(Step 5)

Next, a forming step will be performed. A pulse voltage (ON time: 1 msec/OFF time: 9 msec) of 15 V was applied between the low potential electrode 2 and the high potential electrode 4 so that the electro-conductive film was separated into the high potential side and the low potential side and a gap 6 was formed (FIG. 13E).

The conclusion of forming of the gap 6 was determined by resistant between the electrodes and application of voltage was over at the point of time when the resistant reached 10 MΩ.

(Step 6)

Next, an activation step was performed. The device that went through up to the above described step 5 was installed in a vacuum apparatus 131 as shown in FIG. 14 and evacuation was performed sufficiently until reaching $2\times10^{-6}$ Pa.

Figure 26:
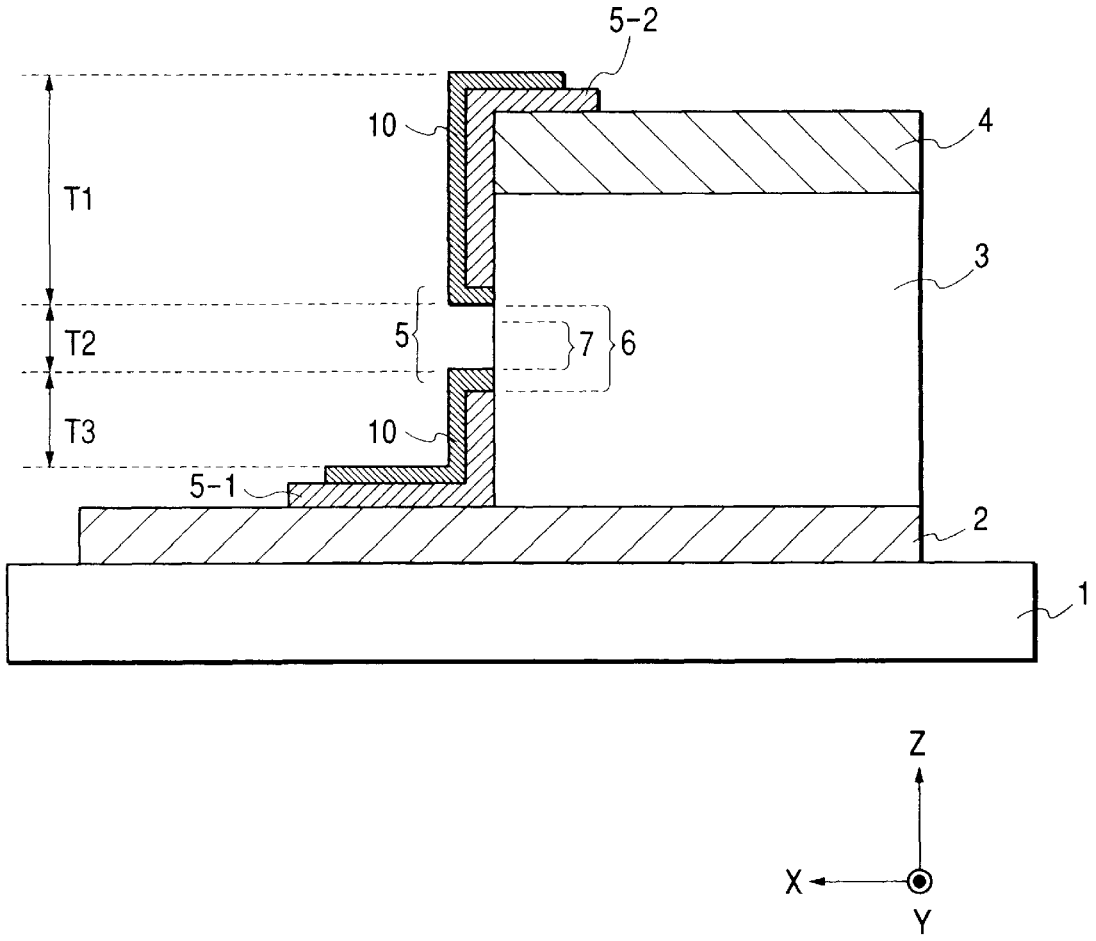
FIG. 26 shows a type of an electron-emitting device according to the present invention.

Next, as an organic material 132, BN (benzonitrile) was introduced into the vacuum apparatus 132 to $1\times10^{-4}$ Pa and a pulse voltage was applied between electrodes 2 and 4 in an organic gas atmosphere. As for the pulse voltage, the pulse voltage of the both electrode with polarity of the ON voltage appearing alternately (bipolar pulse) was applied. As a result thereof, a film 10 of thickness of 2 nm with carbon as a main component was deposited (FIG. 14 and FIG. 26). The above described activation step was over at the point of time when the current If flowing through the device was saturated.

Thereafter, after sufficient evacuation until reaching $2\times10^{-6}$ Pa again, the device were baked at approximately 200° C. for 5 hours so that organic substance that had clung to the device was removed. Width T2 of the gap 7 shown in FIG. 26 that was finally formed was measured with electron microscope observation to be 5 nm. In addition, the carbon film 10 covered the surface of the turning region of the electro-conductive film 5-2 as well.

Upward the electron-emitting device of the present embodiment that was thus produced, an anode electrode 8 was disposed as shown in FIG. 2 so that efficiency as well as the beam diameter was measured.

A pulse voltage consisting of a driving voltage Vf=15 V was applied between the electrodes 2 and 4 in the device so that the device current If flowing between the electrodes 2 and 4 and the main electron-emitting current Ie was measured. As for the beam diameter, a fluorescent plate comprising P22 phosphor and a metal back (Al film) was used as an anode electrode, and Va=10 kV was applied to the Al film departed from the device at a distance of H=2 mm so that luminous intensity distribution there was measured with CCD camera implementing image forming. The beam diameter to be measured was set to have an intensity ratio of 1/100 of the peak intensity. The beam diameter given by this measurement included light spreading inside the phosphor, but that spread is estimated as the beam diameter+40 μm to counter-calculate the beam diameter.

The present embodiment was resulted in efficiency η=1.85%, If=1.5 mA, and Ie=27.8 μA.

In addition, the measured beam diameter was Lw (mes)=120 μm, and Lh (mes)=240 μm. Approximating the beam diameter of electrons without any spread of the phosphor is resulted in Lw=90 μm, Lh=200 μm, and moreover, approximating from the equations (3a) and (3b) gives Kw=0.33 and Kh=0.61.

In the present embodiment, the gap 7, that was formed approximately in the center of the insulating layer, will be:

T1=(thickness of the insulating layer 3/2)+(thickness of the high potential electrode 4)+(thickness of the electro-conductive film 5-2)+(thickness of the carbon film deposited on the electroconductive film 5-2 with the activation step)−(width of the gap 7/2)=20+5+4+2−2.5=28.5 nm In addition, T3 will be:

T3=(thickness of the insulating layer 3/2)−(thickness of the electroconductive film 5-1)−(thickness of the carbon film deposited on the electroconductive film 5-2 with the activation step)−(width of the gap 7/2)=20−4−2−2.5=11.5 nm.

Substituting the above described value of T3 and the work function of carbon φwk=5 eV for the equations (2) as well as (2)', effective T1 in the present invention can be calculated resulting in Tlmax<47 nm, and moreover Tlmax'<31 nm, which will be turned out to exist within the range of shape proposed by the present invention. Accordingly, increasing efficiency in the electron-emitting efficiency and increasing in high minuteness has been realized.

In addition, in the present embodiment, the equation (1) gives Xs=0.95 μm, resulting in width of the high potential electrode being L1=30 μm, width of the low potential electrode being L2=30 μm, that is larger than Xs by more than 15 times to fall within the range to which the present invention is applicable.

[Embodiment 2]

Figure 20:
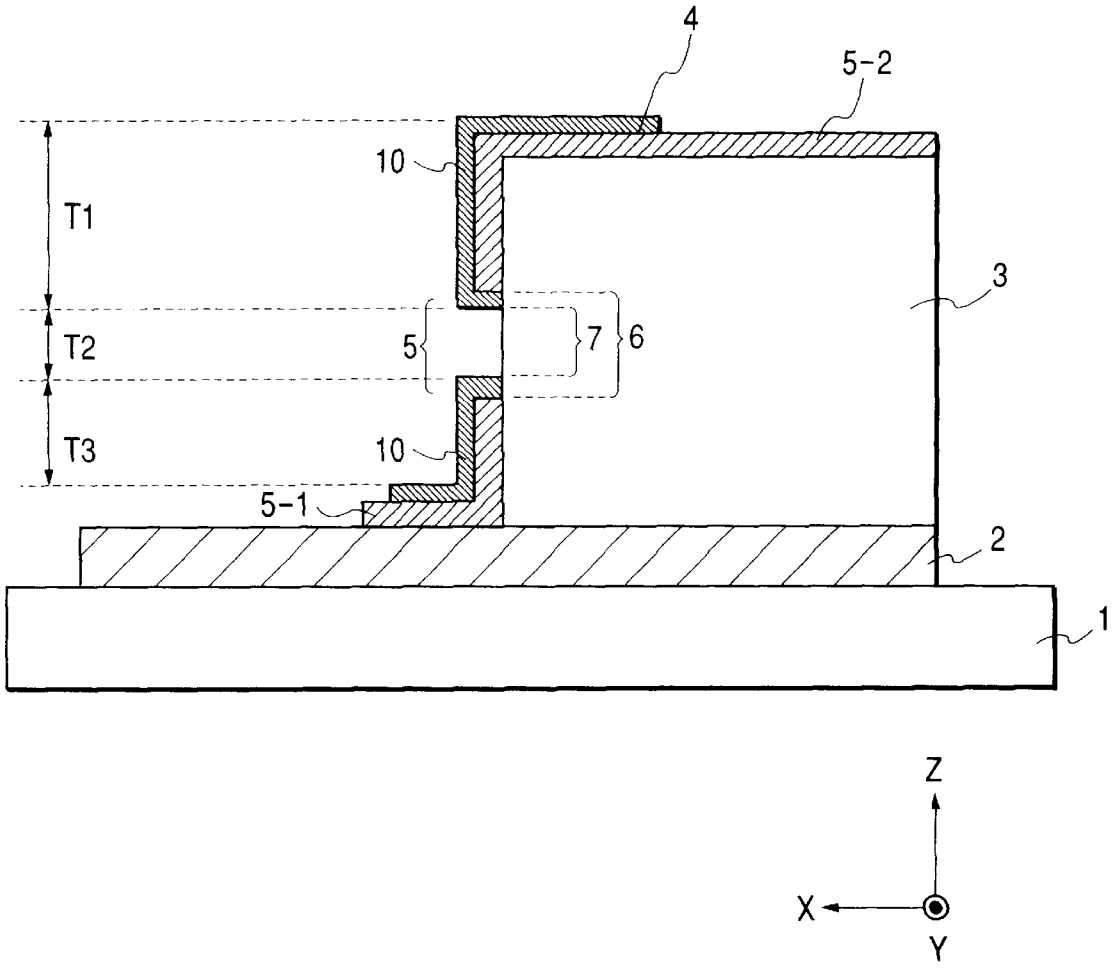
FIG. 20 shows an embodiment 2 of the electron-emitting device according to the present invention.

With reference to FIG. 20, an electron-emitting device that was produced in the present embodiment will be described.

In the present embodiment, in order to reduce T1, the high potential electrode 4 that was used in Embodiment 1 was omitted and the high potential side electroconductive member is configured only with the electroconductive film 5-2.

The producing method is the almost same as in Embodiment 1 with an exception that steps of sedimentation of the high potential electrode and processing are omitted in Embodiment 1 (Step 3).

In the present embodiment, given is:

T1=(thickness of the insulating layer 3/2)+(thickness of the electroconductive film)+(thickness of the carbon film deposited on the electroconductive film 5-2 with the activation step)−(width of the gap 7/2)=20+4+2−2.5=23.5 nm In addition, moreover, in order to change distance T1 from the position of the gap 7 in the device of Embodiment 1, thickness of the high potential electrode was changed from 10 nm to 500 nm to measure efficiency and the beam diameter.

These results will be wrapped up and will be shown in Table 1. Incidentally, If was approximately the same as in Embodiment 1.

TABLE 1

T1, efficiency and beam diameter

| T1 (nm) | Thickness of the electrode 4 (nm) | Efficiency η (%) | Beam diameter Lw (μm) | Beam diameter Lh (μm) | |
|---|---|---|---|---|---|
| 23.5 | — | 1.87 | 90 | 200 | Embodiment 2 |
| 28.5 | 5 | 1.85 | 90 | 200 | Embodiment 1 |
| 33.5 | 10 | 1.68 | 100 | 220 | |
| 73.5 | 50 | 0.6 | 120 | 250 | |
| 123.5 | 100 | 0.12 | 140 | 290 | |
| 523.5 | 500 | 0.08 | 150 | 290 | |
| — | — | 0.78 | 150 | 290 | Prior art plane type |

This result corresponds with the graph in FIG. 4A. This serves to clarify that reduction in length of the high potential region is effective for improvement of efficiency and effective to enhance high minuteness of the beam diameter. However, as shown in the present embodiment, smaller T1 gets, the related effect tends to get saturated.

[Embodiment 3]

Figure 21:
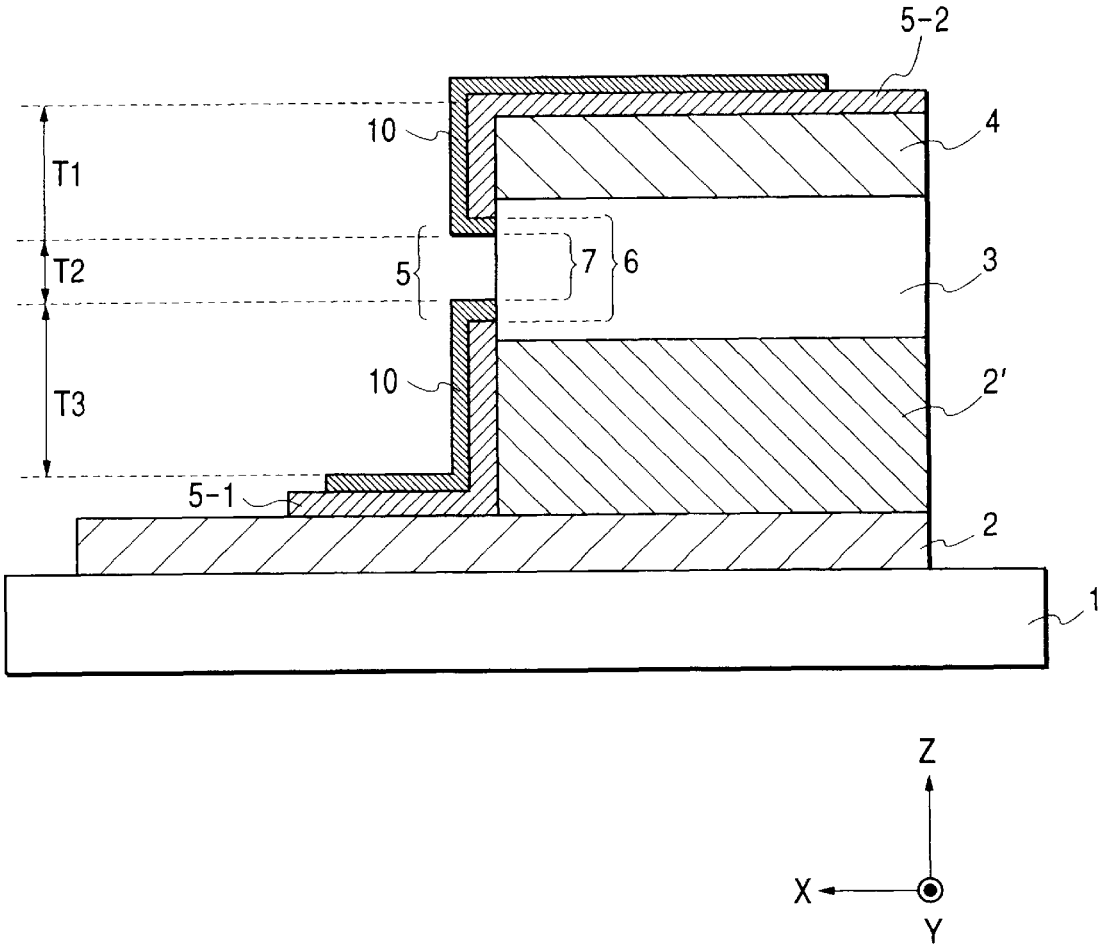
FIG. 21 shows an embodiment 3 of the electron-emitting device according to the present invention.

With reference to FIG. 21, Embodiment 3 of an electron-emitting device will be described. The present embodiment is configured to have T3 that is made large to effectuate improvement in efficiency.

The producing method is the same as in Embodiment 1 with an exception that (Step 1) and (Step 3) will be changed and replaced with (Step 1') and (Step 3') as follows.

(Step 1')

Using silica for a substrate 1, and subject to sufficient cleaning, Al—Ta alloy layer of thickness of 200 nm and a metal layer made of highly pure Ta of thickness of 500 nm were deposited with sputtering method.

Next, a resist pattern was formed using positive photo resist (AZ1500/produced by Clariant K.K.).

Next, with the above described photo resist subject to patterning as a mask, the Al—Ta alloy layer and the metal layer made of Ta were simultaneously dry-etched with $Cl_2$ gas of an entire pressure of 4 Pa.

(Step 3')

Next, the insulating layer of thickness of 40 nm and the metal layer made of Ta of thickness of 5 nm were deposited in a serial fashion.

Next, the above described photo resist subject to patterning as a mask, the metal layer made of Ta, the insulating layer, and the metal layer made of Ta were dry-etched with etching gas of $CF_4$ and the process was caused to halt on the Al—Ta alloy layer, utilizing difference in selection ratio by the etching gas for the Al—Ta alloy layer and the metal layer made of Ta. This served to form a lamination configuration of a first low potential electrode 2 made of Al—Ta alloy layer and a second low potential electrode 2' made of Ta, an insulating layer 3, and a high potential electrode 4 made of Ta.

An electron-emitting device was produced with steps similar to those in Embodiment 1 as follows.

As in Embodiment 1, the device was driven with Vf=15 V, and Va=10 kV was applied to the anode electrode that is departed from the device by H=2 mm so that the device was assessed.

The present embodiment was resulted in efficiency η=2.0%, the measured beam diameter of Lw (mes)=140 μm and Lh (mes)=260 μm.

Approximating the beam diameter of electrons without any spread of the phosphor is resulted in Lw=100 μm, Lh=210 μm, and moreover, approximating from the equations (3a) and (3b) gives Kw=0.65 and Kh=0.55.

In the present embodiment, T1 and T3 are given as follows:

T1=(thickness of the insulating layer 3/2)+(thickness of the high potential electrode 4)+(thickness of the electroconductive film 5-2)+(thickness of the carbon film deposited on the electroconductive film 5-2 with the activation step)−(width of the gap 7/2)=20+5+4+2−2.5=28.5 nm, that is the same in the first embodiment.

On the other hand, T3 will be:

T3=(thickness of the second low potential electrode 2' made of Ta)+(thickness of the insulating layer 3/2)−(thickness of the electroconductive film 5-1)−(thickness of the carbon film deposited on the electroconductive film 5-2 with the activation step)−(width of the gap 7/2)=500+20−4−2−2.5=511.5 nm.

Accordingly, substituting the above described value of T3 and the work function of carbon φwk=5 eV for the equation (2)', effective T1 in the present invention can be calculated resulting in Tlmax'<336 nm, which will be turned out to exist within the range of shape proposed by the present invention.

Accordingly, increasing efficiency in the electron-emitting efficiency and increasing in high minuteness has been realized.

In the present embodiment, excavation in the low potential electrode will provide with high efficiency more than in Embodiment 1 even with the same T1. However, the electron beam diameter was slightly widened. The reason hereof is considered that enlargement of T3 results in widening the above described equal potential field of (Vf−φwk) from the high potential field and in increasing electrons that reach without scattering among electrons emitted downward in the z direction from the gap, and in enhancing the efficiency, but on the other hand, is considered that distribution of reaching position of the electrons as a result thereof is slightly enlarged, resulting in widening the electron beam.

In addition, enlargement of T3 served to reduce dispersion in efficiency when devices more than in Embodiment 1 were formed. The result thereof is considered that at the time of production of the device the position of the gap happens to not necessarily come to the center portion of the insulating layer, giving rise to, in that case, dispersion of devices, but enlargement of T3 resulted in decreasing dispersion of their relative positions.

[Embodiment 4]

Figure 22:
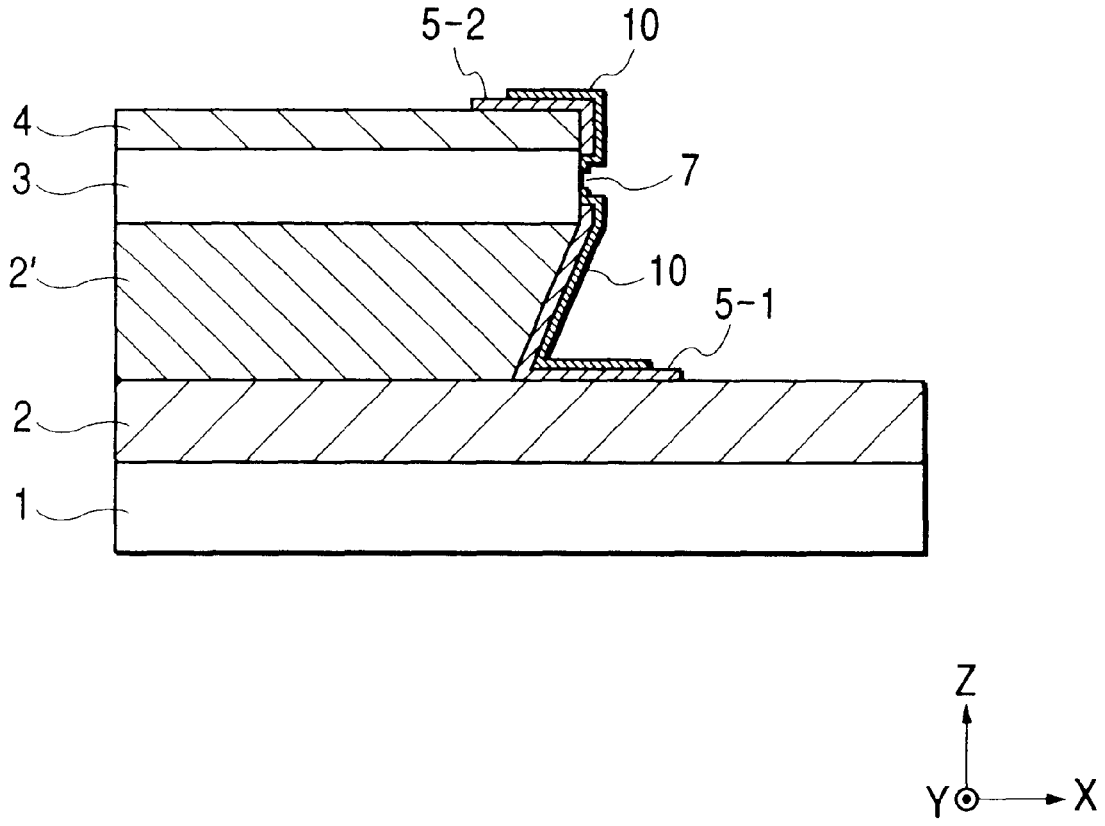
FIG. 22 shows an embodiment 4 of the electron-emitting device according to the present invention.

With reference to FIG. 22, Embodiment 4 of an electron-emitting device will be described.

The present embodiment is a variation involving slight difference in configuration of T3, and the sectional view of the second low potential electrode 2' made of Ta is shaped into a reverse taper with etching.

In this case, the portion upper the insulating layer 3, that is, the periphery of the gap 7 is as in Embodiment 3.

As in Embodiment 1, the device was driven with Vf=15 V, and Va=10 kV was applied to the anode electrode that is departed from the device by H=2 mm so that the device was assessed.

The present embodiment was resulted in efficiency η=2.05%, and If was as in Embodiment 3.

In addition, the measured beam diameter was Lw (mes)=140 μm and Lh (mes)=260 μm. Approximating the beam diameter of electrons without any spread of the phosphor was resulted in Lw=100 μm, Lh=210 μm, and moreover, approximating from the equations (3a) and (3b) gives Kw=0.65 and Kh=0.55.

As compared with Embodiment 3, in the present embodiment, efficiency was slightly improved while the beam diameter was as in Embodiment 3.

As for T3, a reverse taper results in slight improvement in efficiency. The reason hereof is considered that enlargement as in the Embodiment 3 results in widening the equal potential field of (Vf−φwk) from the high potential field and in increasing electrons that reach without scattering among electrons emitted downward in the z direction from the gap, and in enhancing the efficiency.

However, as described later, inclination in the gap portion as well as the high potential electrode leads to deterioration in characteristics and there will arise a big difference unlike the present embodiment.

[Embodiment 5]

In the present embodiment, producing method of a gap is different from that in Embodiment 1, but basic configuration of a device is the same as shown in FIGS. 11A and 11B.

(Step 1')

A silica substrate is used for a substrate 1, and subject to sufficient cleaning, as material for a low potential electrode 2, Ta of thickness of 500 nm was deposited with sputtering method.

Next, in a photolithography step, a resist pattern was formed using positive photo resist (AZ1500/produced by Clariant K.K.).

Next, with the above described photo resist subject to patterning as a mask, the Ta layer was dry-etched with $CF_4$ gas to form the low potential electrode 2.

(Step 2) is the same as in Embodiment 1.

(Step 3')

As material for the insulating layer 3, $SiO_2$ of thickness of 70 nm and as material for the high potential electrode 4, Ta of thickness of 10 nm were deposited.

Next, in a photolithography step, a resist pattern was formed using positive photo resist (AZ1500/produced by Clariant K.K.).

Next, with the above described photo resist subject to patterning as a mask, material of the high potential electrode 4, materials of the insulating layer 3 and a portion of the low potential electrode 2 were etched with RIE. $CF_4$ gas was selected as etching gas. In addition, other conditions at dry-etching depend on size, configuration, and substrate size, and in the present embodiment, pressure of 2.7 Pa and discharge power of 1000 W were used. Depth of etching for the low potential electrode 2 was set at 200 nm and the etching period was controlled so that the process is halted at a desired thickness.

Width of electrode produced during steps so far, L1 was 30 μm with L2=30 μm. In addition, opening width of the low potential electrode in the y direction was set at 200 μm.

(Step 4')

Next, with photolithography technology, an opening was formed in the photo resist.

Next, Ta film of thickness 7 nm as electroconductive film 5 was deposited. Thereafter, the photo resist was delaminated so that the electro-conductive film 5 was formed with a lift-off method in the center portion of the device over the high potential electrode and the low potential electrode. The device length L0 was set at 50 μm.

(Step 5')

Next, a forming step will be implemented. A pulse voltage (ON time: 5 msec/OFF time: 15 msec) was applied between the low potential electrode 2 and the high potential electrode 4 with the wave height value to be caused to increase from 10 V to 20 V at 1 V/sec. This step served to separate the electro-conductive film 5 into the high potential side and the low potential side and form a gap 6 in the Ta film.

Formation of the gap 6 was determined by resistant between the electrodes and application of voltage was over at the point of time when the resistant reached 10 MΩ.

(Step 6)

The activation step implemented in Embodiment 1 was not implemented in the present embodiment.

Width T2 of the gap 6 was measured with electron microscope observation to be T2=8 nm.

On the thus produced electron-emitting device of the present embodiment according to Embodiment 5, efficiency as well as the beam diameter was measured as in Embodiment 1. However, the driving voltage Vf was set at Vf=18 V.

The present embodiment was resulted in efficiency η=2.1%, but If=0.5 mA, that was small compared with that in other embodiments, and accordingly the electron-emitting quantity Ie became Ie=10.5 μA that was slightly small.

The measured beam diameter was Lw (mes)=150 μm, and Lh (mes)=270 μm. Approximating the beam diameter of electrons without any spread of the phosphor is resulted in Lw=110 μm, Lh=230 μm, and moreover, approximating from the equations (3a) and (3b) gives Kw=0.65 and Kh=0.53.

In the present embodiment, the gap, that was formed approximately in the center of the insulating layer, will be:

T1=(thickness of the insulating layer 3/2)+(thickness of the high potential electrode 4)+(thickness of the electroconductive film 5-2)−(width of the gap 6/2)=35+10+7−4=48 nm.

In addition, T3 will be:

T3=(depth of etching of the low potential electrode 2 in the above described step 3')+(thickness of the insulating layer 3/2)−(thickness of the electroconductive film 5-1)−(width of the gap 6/2)=200+35−7−4=229 nm.

In the present embodiment, the electroconductive film 5 configures the surface of the high potential side electroconductive member, and its work function will become a work function of Ta. Accordingly, substituting the above described value of T3, the driving voltage Vf=18 V, and the work function of T3 φwk=4.1 eV for the equations (2)', effective T1 in the present embodiment can be calculated resulting in Tlmax'<680 nm, which will be turned out to exist within the range stipulated by the present invention.

Accordingly, increasing efficiency in the electron-emitting efficiency and increasing in high minuteness was realized.

With lower work function φwk and larger driving voltage Vf, maximum flight distance of electrons will get longer, and therefore T1max' permitted due to high efficiency can be made extremely large.

However, careful attention is required since the width of the electron beam diameter that will become larger.

In the present embodiment, it is clarified that under different materials and different driving conditions, the equation (2)' will be the standard so that the shape according to the present invention is the condition to realize high efficiency and high minuteness.

[Embodiment 6]

With reference to FIGS. 9A and 9B, an embodiment 6 of an electron-emitting device will be described.

In the embodiments so far, the sectional views on the high potential electrode 4 and on the insulating layer 3 were approximately perpendicular, but in the present embodiment not perpendicular.

Producing method was as in Embodiment 1 but etching conditions such as gas pressure and etching power, etc. were changed, and moreover, as for the etching method, dry etching was replaced with wet etching, and devices having various angles were produced.

As in Embodiment 1, the device was driven with Vf=15 V, and Va=10 kV was applied to the anode electrode that is departed from the device by H=2 mm so that the device was assessed.

TABLE 2

Inclination angle, efficiency and beam diameter

| Degree (°) | Efficiency η (%) | Beam diameter Lw (μm) | Beam diameter Lh (μm) | |
|---|---|---|---|---|
| 40 | 0.8 | 150 | 290 | |
| 55 | 0.9 | 120 | 280 | |
| 78 | 1.4 | 100 | 240 | |
| 85 | 1.85 | 90 | 200 | |
| 93 | 1.85 | 90 | 200 | |
| 122 | 0.5 | 95 | 220 | |
| — | 0.78 | 150 | 290 | Prior art plane type |

This result corresponds with the graph in FIGS. 10A and 10B.

As a result hereof, the inclination angle θ correlates with effects in the present and 90 degrees±10 degrees will not make any difference in effects thereof, but as the angle get smaller, effects will come closer to the prior art plane type, and in addition, with a reverse taper, the electron beam diameter will not change so much but nevertheless efficiency will appear to extremely drop.

In addition, in order to obtain effects different from those for the prior art plane type, the inclination angel θ will be standardized at not less than 45 degrees and not more than 100 degrees.

[Embodiment 7]

With reference to FIG. 16 though FIG. 19, an electron source and an image-forming apparatus in which the electron-emitting devices of the present invention are arranged will be described. As the electron-emitting device for application, the devices produced in Embodiment 1 (FIGS. 11A and 11B) were used.

In the image-forming apparatus, when the capacity of a device increases accompanied by disposition in plurality, in the matrix wiring shown in FIG. 16, the quantity component will loose wave forms even if short pulses are added accompanied by pulse width modulation, giving rise to such problems that expected gradation will not be obtainable.

Thus in the present embodiment, as shown in Embodiment 1, an inter-layer insulating layer shown in 111 in FIGS. 11A and 11B is disposed immediately next to the electron-emitting region, and configuration so as to reduce increase in capacity component other than the electron-emitting region is adopted.

In addition, the inter-layer insulating layer 111 also works so as to reduce influence of the adjacent devices in the x direction.

In the configuration according to the present embodiment, the trajectoies of electrons emitted form the devices are biased to the high potential side to reach the upper portion of the adjacent devices in the vicinity of the anode electrode. Accordingly, the configuration is apt to influence of the adjacent devices, in particular the adjacent device in the x direction.

In order to obtain the effects according to the present embodiment, as described above, the width L1 in the x direction of the high potential electrode has been set at larger than 15 times the characteristic distance Xs defined under driven state so as not to be influenced by the electron trajectoies of the adjacent potentials. Moreover, the inter-layer insulating layer 111 is laminated and the high potential is disposed at higher position to give rise to a configuration that will get little influenced by the low potential of the adjacent devices.

Moreover, other than at the time of driving, the inter-layer insulating layer 111 will become important.

For example, during the above described activation step, approximately the same voltages as at the time of driving will be applied with alternate polarity. Therefore, in the activation step, under the state where the high potential will be also applied to the low potential electrode 2, there is possibility that electrons from the electron-emitting region 5 might fly and reach the periphery of the devices. In this case, in the case where the inter-layer insulating layer 111 will not be provided, a comparatively high electric field will be formed in the periphery of the low potential electrode 2. As a result thereof, a clung substance, etc. is disposed in the periphery of the low potential electrode 2, resulting in probable occurrence of leak current between the adjacent devices or trigger of discharging destruction.

Disposing a thicker inter-layer insulating layer 111, forming of high electric field in the region between the adjacent devices will be controlled and stable activation will be implemented.

X directional wire 152 of m units in FIG. 16 consists of Dx1, Dx2, . . . , Dxm, and is configured by Al of thickness of approximately 0.5 μm and width of 250 μm. In the present embodiment, the low potential electrode 2 is on duty instead. Moreover, disposition of wiring consisting of another material at the lower portion of the low potential electrode is a configuration that can be appropriately designed.

Y directional wire 153 of n units consists of Dy1, Dy2, . . . , Dyn, and is configured by Ta of thickness of approximately 5 nm and width of 100 μm as shown in FIGS. 11A and 11B. In the present embodiment, the high potential electrode 4 is on duty instead.

An inter-layer insulating layer made of $SiO_2$ of 0.5 μm is further provided between the m units of the x directional wire 152 and the n units of the y directional wire 153 to electrically separate the both parties.

In order that the inter-layer insulating layer can tolerate the potential at the intersection between the x directional wire 152 and the y directional wire 153, in the present embodiment, thickness of the inter-layer insulating layer was determined so that the device capacitance per device would be not more than 1 pF and the device tolerance voltage be 25 V. Moreover, disposition of wiring consisting of another material at the upper portion of the high potential electrode, in particular only in the region where the inter-layer insulating layer is disposed, is a configuration that can be appropriately designed.

The x directional wire 152 and the y directional wire 153 are respectively pulled out as external terminals.

The x directional wire 152 is connected with the not shown scanning signal application means which apply the scanning signal to select lines of electron-emitting devices 154 of the present invention arranged in the x direction.

On the other hand, the y directional wire 153 is connected with the not-shown modulated signal generating means to modulate each column of the electron-emitting devices 154 of the present invention arranged in the y direction in accordance with the input signals.

The driving voltage which is applied to each electron-emitting device 154 is supplied as differential voltage between the scanning signal and the modulated signal to be applied to the device 154. In the present embodiment, the y directional wire was brought into connection with the high potential and the x directional wire with the low potential. Configuration will become so as to make a desired potential structure for the present embodiment to be obtainable.

In the above described configuration, simple matrix wiring is used to enable respective devices to be selected independently and to drive independently.

An image-forming apparatus that has been configured by usage of an electron source in such a simple matrix disposition will be described with reference to FIG. 17. FIG. 17 is a perspective view showing a display panel of an image-forming apparatus using soda lime glass as glass substrate material.

In FIG. 17, reference numeral 151 denotes an electron source substrate in which plurality of electron-emitting devices have been disposed, reference numeral 161 denotes a rear plate on which the electron source substrate 151 is fixed, reference numeral 166 denotes a face plate in which fluorescent film 164 and metal back 165, etc. are formed inside the glass substrate 163.

Reference numeral 162 denotes a supporting frame and the rear plate 161 and the face plate 166 have been brought into connection with the supporting frame 165 with flit glass, etc.

An envelope 167 is configured by sealing by burning processing for 10 minutes under a temperature range of 450° C. in a vacuum space.

For the present case, stripe structure in FIG. 18A was used.

For the black stripe material, in the present embodiment, material involving normally used graphite as a main component was used. As phosphor, P22 was used.

In FIG. 17, metal back 165 was provided on the interior surface of the fluorescent film 164.

The metal back 165 was formed by implementing smoothing processing on the surface of interior party of the fluorescent film (normally called "filming") after the fluorescent film was formed, and thereafter by depositing Al using vacuum evaporation method, etc.

The face plate 166 was normally provided with an electrode made of electroconductive carbon (not shown) to the interior party of the metal back 165 in order to further improve electro-conductivity of the fluorescent film 164.

When the above described sealing is implemented, the position of the fluorescent film is required to correspond with the electron-emitting devices. In the case of the image-forming apparatus in the present embodiment, the electron-emitting devices and the fluorescent film are misplaced in the x direction, and therefore in consideration of this misplacement under driving condition, positioning was implemented.

In the present embodiment, a distance H between the electron source and the fluorescent film was set at 2 mm and the driving conditions were set at Vf=15 V and Va=10 kV. In addition, the phosphor was disposed in the position corresponding with the position shifted by 150 $\mu$m in the shooting direction of electrons from the electron source.

Size of a pixel in the present embodiment is 150 $\mu$m in the x direction and 250 $\mu$m in the y direction.

Next, with reference to FIG. 19, described will be a configuration example of a driving circuit to implement television display based on television signals of the NTSC system onto the display panel thus configured.

A scanning circuit 182 will be described. The said circuit comprises m units of switching devices (which are shown as a model with Sl through Sm in the drawing) inside itself. Each switching device selects either of the output voltage of the direct voltage source Vx or 0 [V] (the ground level), and is electrically connected with the terminals D×1 thorough D×m of the display panel 181.

Each switching device of S1 through Sm is to operate based on the controlling signal TSCAN which the controlling circuit 183 outputs, and can be configured by combining switching devices such as FET for example.

In this example, based on the features of the electron-emitting device (electron emission threshold voltage) of the present invention, the direct voltage source Vx is set to output such a constant voltage that the driving voltage to be applied to the elements not yet scanned will be not more than the electron emission threshold voltage.

The controlling circuit 183 has a function to implement matching among each portions so that appropriate display may be implemented based on the image signal inputted from outside. Based on the synchronization signal TSYNC to be sent from the synchronization signal separation circuit 186, the controlling circuit 183 generates controlling signals respectively of TSCAN, TSFT and TMRY to each portion.

The synchronization signal separation circuit 186 is a circuit to separate the synchronization signal component and the brightness signal component from the television signals of the NTSC system to be inputted from outside, and can be configured by using frequency separation (filter) circuit, etc. generally available.

The synchronization signals separated by the synchronization signal separation circuit 186 comprise vertical synchronization signals and horizontal synchronization signals, and here for the descriptive convenience have been illustrated as TSYNC signals. The image brightness signal component separated from the above described television signals was represented as DATA signal for purpose of convenience. The DATA signal is inputted to the shift register 184.

The shift register 184 is to proceed with serial/parallel-converting on a line-by-line basis on images the above described DATA signals which are inputted serially in a chronological fashion, and to operate based on the controlling signals TSFT to be sent by the above described controlling circuit 183 (that is, the controlling signals TSFT can be referred to as a shift clock of the shift register 184).

The data for a line of serial/parallel-converted image (equivalent to driving data for N-unit devices of the electron-emitting devices) is outputted from the above described shift register 184 as N-unit parallel signals of Id1 through Idn.

The line memory 185 is a memory device to memorize the data for a line of image for a necessary time period, and memorizes contents of Id1 through Idn appropriately in accordance with the controlling signals TMRY to be sent from the controlling circuit 183. The stored contents are outputted as Id'1 through Id'n, and inputted to the modulation signal generator 187.

The modulation signal generator 187 is a signal source to appropriately drive and modulate each of the electron-emitting device in accordance with each of the image data Id'l through Id'n, and its output signals are applied to the electron-emitting devices in the display panel 181 through the terminals Doyl through Doyn.

As described above, the electron-emitting device has the following basic features toward the emission current Ie. That is, there is a clear threshold voltage Vth for electron emission, and only when a voltage not less than the threshold voltage is applied, electron emission takes place. For a voltage not less than the threshold voltage Vth, emission current changes in accordance with changes of voltage applied to the devices.

Based on this, when pulse-shaped voltage is applied to the present devices, for example, a voltage not more than the electron emission threshold value, electron emission does not take place, but when a voltage not less than the electron emission threshold value is applied, an electron beam is outputted.

In that case, changes in the wave height value of the pulses Vm enable to control intensity of the output electron beams. In addition, changes in the pulse width Pw enable to control total quantity of charges of the outputted electron beams.

Accordingly, as a system to modulate the electron-emitting device in accordance with the input signals, a voltage modulation system, a pulse width modulation system, etc. can be adopted. At the time when the voltage modulation system is implemented, as the modulation signal generator 187, such a circuit of voltage modulation system that generates voltage pulses with a constant length and modulates the wave height value of the pulses appropriately in accordance with the inputted data can be used.

At the time when the pulse width modulation system is implemented, as the modulation signal generator 187, such a circuit of pulse width modulation system that generates voltage pulses with a constant wave height value and modulates the voltage pulse width appropriately in accordance with the inputted data can be used.

As for the shift register 184 or the line memory 185, digital signal system was used.

In the present embodiment, D/A conversion circuit for example is used as the modulation signal generator 167, and an amplifying circuit, etc. is attached thereto in accordance with necessity. In the case of the pulse width modulation system, as the modulation signal generator 187, used was a circuit combining for example a high speed oscillator, a counter to count waves outputted from the oscillator, and a comparator to compare the output value of the counter and the output value of the above described memory.

The configuration of image-forming apparatus having been described herein are one example of image-forming apparatus to which the present invention is applicable, and based on the technological philosophy of the present invention, various variants are possible. As concerns the input signals, the NTSC system has been nominated, but the input signals are not limited hereto, and in addition to PAL, and SECAM system, etc., TV signal systems (for example, high definition TV such as MUSE system) consisting of more numerous scanning lines can be adopted.

Moreover, measurement of Va dependency of the device of the present embodiment resulted in the graph shown in FIG. 6.

This clarified that sufficient efficiency was obtainable even when the device of the present embodiment was used under Va=5 to 6 kV. In addition, the beam diameter was widened by approximately 30% in the x direction and by approximately 20% in the y direction, but suffered from little change in the emitting position and it was clarified that it could be used with the similar configuration.

Possibility in lowering Va can lower the load of the high voltage power source, and reduce probability of occurrence of discharging inside the panel, and another effect that plan cost reduction for producing the panel and longevity of the panel can be planned can be expected.

[Embodiment 8]

Moreover, an embodiment of another image-forming apparatus being configured similar to Embodiment 7 will be shown. In the present embodiment, the producing method is almost the same as in Embodiment 7, and the image-forming apparatus was produced subject to change in distance between the electron source and the phosphor.

In the present embodiment, the distance H was changed to 2 mm to 5 mm. For that purpose, the height of the supporting frame 162 was changed and an envelope was produced. In addition, quantity of misplacement between the electron source and the phosphor was appropriately changed.

In the case of the image-forming apparatus of the present embodiment, contrast dropped slightly up to H=4 mm in Embodiment 7, but fell within a practically possible range.

Result on efficiency as well as the beam diameter when driving was implemented under Vf=15 V and Va=10 kV will be shown in Table 3.

TABLE 3

Efficiency as well as the beam diameter when driving was implemented under Vf = 15 [V] and Va = 10 [kV]

| H (mm) | Efficiency η (%) | Beam diameter Lw (μm) | Beam diameter Lh (μm) |
|---|---|---|---|
| 2 | 1.85 | 90 | 200 |
| 3 | 1.72 | 120 | 320 |
| 4 | 1.0 | 160 | 420 |
| 5 | 0.3 | 240 | 520 |

Up to H=4 mm, drop in efficiency is not so big. This clarifies that, for the present device, the condition of H=2 mm was a condition for a sufficiently high efficiency, and that up to H=4 mm was a condition for the components without scattering to reach the anode electrode. With H=5 mm, the efficiency dropped steeply and became in sufficient for display performance.

In addition, the fluorescent pixel pitch of the present embodiment is in a stripe configuration with 150 μm in the x direction and 250 μm in the y direction to such an degree that the electron beam was slightly kicked toward the x direction, but it is clarified that the electron beam is misplaced from the fluorescent in the y direction. It is considered that the contrast dropped accordingly.

Next, with the x direction as was, but for the y direction, the pitch of the phosphor as well as the electron source in the y direction was changed in accordance with the width of the electron beam, the image-forming apparatus was obtained with good contrast up to H=4 mm.

As shown in the present embodiment, increase in high minuteness in the electron beam diameter of the present invention is remarkable toward the x direction, and since its electron beam shape will become oval or like a line rather than circular, in the case where the image-forming apparatus is configured, is suitable that the longitudinal direction of the phosphor and the longitudinal direction of the devices are made to coincide and a phosphor in stripe configuration is used.

[Embodiment 9]

Figure 23A:
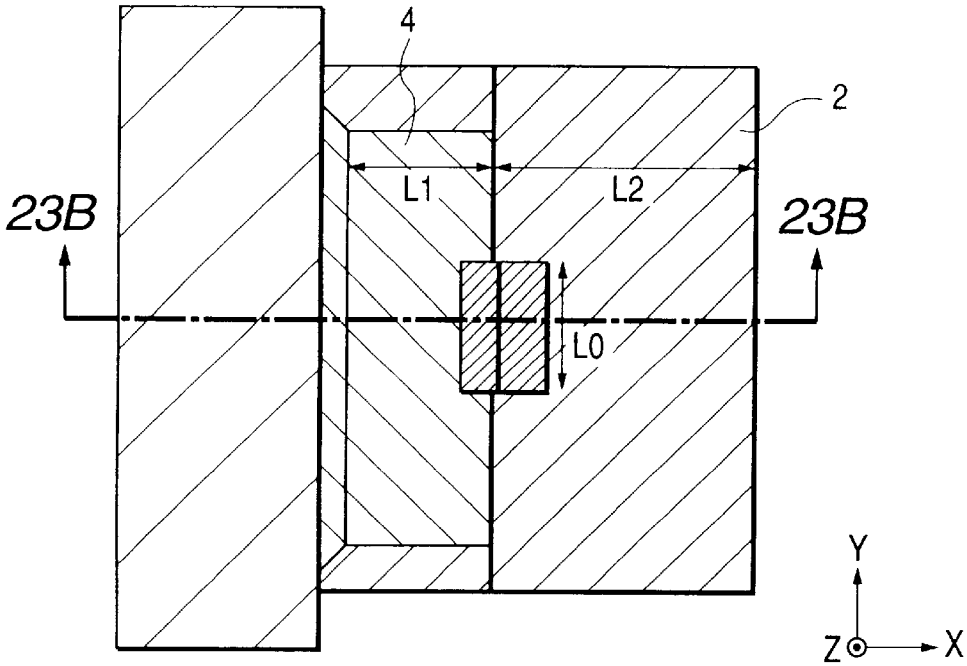
FIGS. 23A and 23B show an embodiment 9 of the electron source according to the present invention.
Figure 23B:
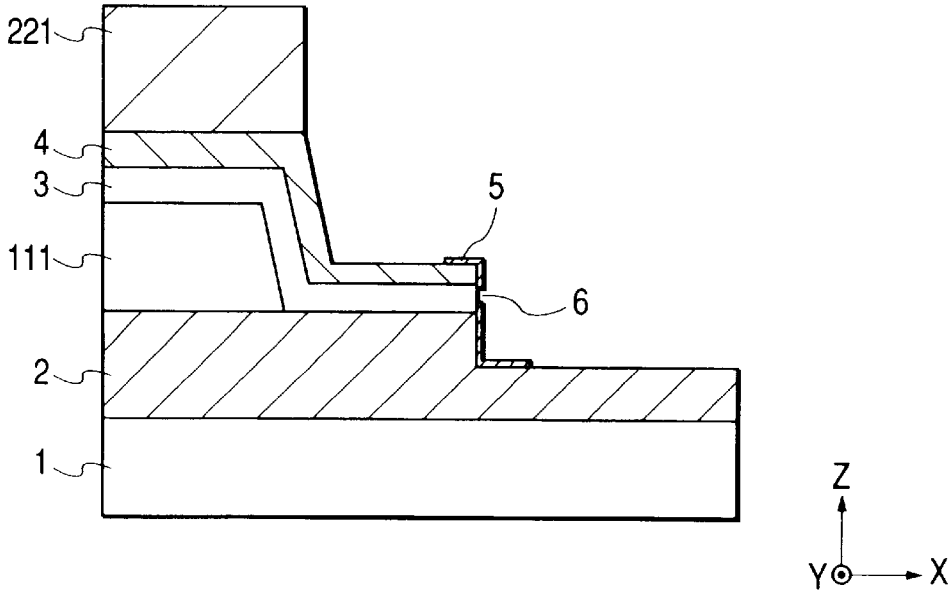

In the present embodiment, a variation of configuration of the electron source will be shown. A region of a device configuring an electron source of the present embodiment is shown in FIGS. 23A and 23B. In addition, an example of disposition of the electron source and the phosphor concerning a color image-forming apparatus using this electron source was shown in FIG. 24.

Firstly, a producing method of the electron source of the present embodiment will be described.

(Step 1)

Using a silica substrate for a substrate 1, and subject to sufficient cleaning, as a low potential electrode 2, Al of thickness of 2 μm and subsequently Ta of thickness of 500 nm were deposited with sputtering method.

Next, in a photolithography step, a resist pattern was formed using positive photo resist (AZ1500/produced by Clariant K.K.).

Next, with the above described photo resist subject to patterning as a mask, the Al layer was dry-etched with chloride gas such as $BC_3$ or the like to form the low potential electrode 2 also functioning as a wiring.

(Step 2)

With RF sputtering method, $SiO_2$ of thickness of 1 μm was deposited as material for an inter-layer insulating layer 111.

Next, a resist pattern was formed using positive photoresist (AZ1500/produced by Clariant K.K.) during a photolithography step.

Next, with the above described photoresist subject to patterning as a mask, the $SiO_2$ layer was wet-etched with fluoro oxides to be caused to halt on the upper surface of the low potential electrode 2 to form the inter-layer insulating layer 111.

The sectional view of the inter-layer insulating layer 111 was arranged to have a moderate inclination to prevent film break due to the step portion of the later-described insulating layer 3 in Step 3 as well as the inter-layer insulating layer 111 of the high potential electrode 4.

(Step 3)

An $SiO_2$ layer of thickness of 50 nm was deposited as material for the insulating layer 3 and a Ta layer of thickness of 20 nm as material for the high potential electrode 4.

Next, a resist pattern was formed using positive photoresist (AZ1500/produced by Clariant K.K.) during a photolithography step.

Next, with the above described photoresist subject to patterning as a mask, $SiO_2$ layer, Ta layer, and a portion of the low potential electrode 2 were etched with RIE. $CF_4$ gas was selected as etching gas. In addition, other conditions at dry-etching depend on size, configuration, and substrate size, and in the present embodiment, pressure of 2.7 Pa and discharge power of 1000 W were used. Excavation in the low potential electrode 2 at time was set at 200 nm. The shape is as in FIGS. 23A and 23B.

Width of electrode produced during steps so far, L1 was 15 μm with L2=18 μm. In addition, width of the low potential electrode in the y direction was set at 250 μm.

(Step 4)

Moreover, using a stuck masking, Al of thickness of 1 μm was deposited as a wiring 221 on the high potential electrode 4 with vacuum evaporation method.

(Step 5)

Next, with photolithography technology, an opening of 18 μm×80 μm was formed in the photo resist.

Next, Pt—Pd film of thickness 5 nm as electro-conductive film 5 was deposited at the above described opening. Thereafter, the photo resist was delaminated so that the electroconductive film 5 was formed with a lift-off method over the high potential electrode and the low potential electrode. The device length L0 was set at L0=80 μm.

Thus, a matrix substrate of the electron source, in which a gap is not yet formed, is formed.

(Step 6)

As in Embodiment 7, a display panel is produced.

A supporting frame is disposed between a rear place having an electron source in which plurality of electron-emitting devices (the gap is not yet produced) have been disposed and a face plate in which fluorescent film and metal back, etc. are formed inside the glass substrate so that all of them were sealed with flit glass, etc. to form a display panel (airtight container).

Figure 24:
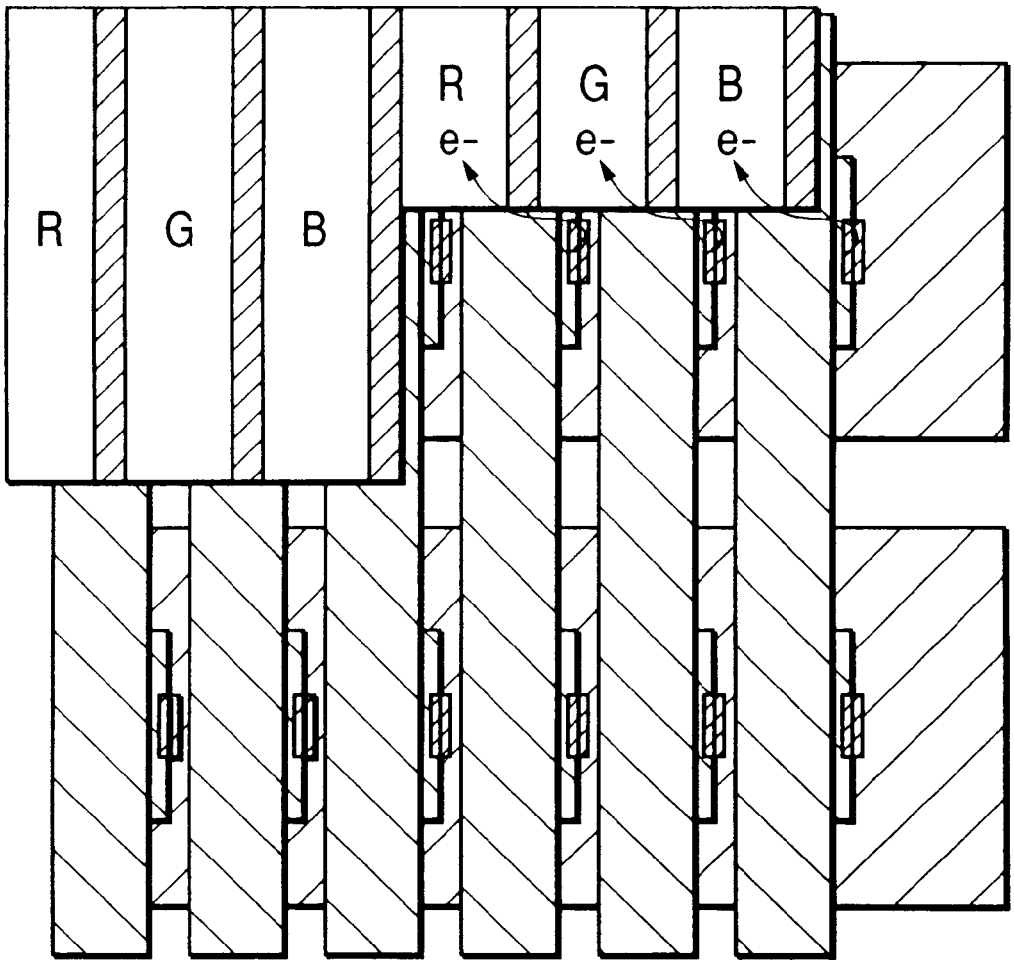
FIG. 24 shows an embodiment 9 of the electron source and a phosphor according to the present invention.

FIG. 24 is a mode view showing a fluorescent film used in the panel of the present embodiment.

In case of the fluorescent film, it is in a stripe configuration by the phosphor of RGB of width 80 μm in the x direction and is configured by 10 μm black stripes between respective fluorescent bodies.

Also in the present embodiment, distance H between the electron source and the fluorescent film was set at 2 mm as in Embodiment 7 and the driving conditions were set at Vf=15 V and Va=10 kV, and the phosphor was positioned so as to be disposed in the position corresponding with the position shifted by 150 μm in the shooting direction of electrons from the electron source for that purpose.

(Step 7)

Next, a forming step will be implemented.

By selecting the x directional wire (low potential electrode 2) on a line-by-line basis, a pulse voltage (ON time: 1 msec/OFF time: 9 msec) of 15 V was applied to the device so that the electroconductive film was separated into the high potential side and the low potential side and a gap 6 was formed in the Pt—Pd film.

The forming of the gap 6 was determined by resistant between the electrodes and application of voltage was over at the point of time when the resistant reached 10 MΩ.

(Step 8)

Next, an activation step was implemented.

The display panel (airtight container) was brought into connection with the evacuation apparatus via an exhaust tube (not shown) and evacuation was implemented sufficiently until reaching $2\times10^{-6}$ Pa.

Next, as an organic material, BN (benzo-nitrile) was introduced into the airtight container to $1\times10^{-4}$ Pa from another exhaust tube (not shown) and a voltage was applied between respective devices in an organic gas atmosphere.

As for the pulse voltage, it is as in the forming step, and the pulse voltage with polarity of the ON voltage replaced alternately was applied. As a result thereof, a film with carbon as a main component was deposited.

The above described activation step was over at the point of time when the current If flowing through the device was saturated.

Thereafter, after sufficient vacuum until reaching $2\times10^{-6}$ Pa again, the entire airtight container was heated at approximately 250° C. for 8 hours.

Thereafter, the exhaust tube (not shown) was sealed so that the getter processing was implemented and the vacuum state inside the envelope was held.

Thus, the image-forming apparatus was produced and under conditions of Vf=15 V and Va=10 kV television display based on television signals of the NTSC system was implemented as in Embodiment 7.

Characteristic with one device of the electron source in the present embodiment was measured, resulting in efficiency η=1.8%, and with Vf=15 V giving device length of 80 μm and Ie=50 μA, sufficient electron emission quantity per device could be secured.

In addition, the beam diameter is Lw=90 μm and Lh=230 μm, and the component in the y direction is sufficiently housed within the span of a pixel. On the other hand, in the x direction, its span is larger than the phosphor size of 80 μm, but since intensity at the skirt of the actual electron beam is not large, accordingly the black stripe of 10 μm disposed between the fluorescent bodies has become effective for improvement in contrast.

Size of a pixel in the present embodiment is 90 μm in the x direction and 270 μm in the y direction. Therefore, unlike Embodiment 1, width of the high potential electrode and the low potential electrode in the x direction was set to become 15 times larger than the characteristic distance Xs being minimum limit having been shown in the present invention.

Also with the device in the present embodiment, the beam diameter in the x direction can be made small, and therefore it is clarified that combination with a face plate having a fluorescent film containing stripe configuration in the x direction can take a highly accurate and minute structure.

Moreover, wiring with thick film thickness was disposed in the x direction and the y direction so that wiring resistant may be reduced as much as possible. In addition, reduction in capacitance at the intersection of wirings or the like was considered with the inter-layer insulating layer.

Considerations so far being extended, the configuration according to the present invention realized to enhance high efficiency in electron emission efficiency and enhance high accuracy and minuteness of the electron beam diameter, and highly accurate and minute pixel disposition was sufficiently possible.

In the configuration of the present embodiment, tolerance on pattern positioning is arranged to be very loose.

In the y direction, length of the low potential electrode is 250 $\mu$m for device length L0=80 $\mu$m, and misplacement of several $\mu$m to several tens $\mu$m is tolerable as well.

In addition, in the x direction, length of the electroconductive film 5 is set at 18 $\mu$m, and for designing to dispose the device portion in the center, since the electroconductive film 5 may well be brought into contact with the high potential electrode 4 and the low potential electrode 2, and into non-contact with the adjacent pixel, misplacement of ±9 $\mu$m for designing is arranged to be tolerable.

In the configuration of the present embodiment, the high potential electrode 4 is thin, and therefore will become a configuration having a parasitic resistant component, but since the wiring 221 is brought into connection in parallel with the device portion, voltage is applied to the device portions uniformly, and thus influence to display performance is controlled to the minimum extremity.

In addition, the wiring 221 reduces wiring resistant in the case of functioning as an image-forming apparatus, and also in the case where the number of pixels becomes large, problems such as drop in image contrast in the center due to parasitic resistant or the like are configured to be prevented.

Accordingly, the image-forming apparatus of the present embodiment was successful in realizing forming of highly accurate and minute color images.

As described so far, the present invention can realize enhancement in high efficiency of electron emission efficiency of electron-emitting devices and enhancement in highly accurate minuteness of electron beam diameter.

In addition, in the image-forming apparatus, without enlarging the pixel size, necessary electron emission quantity can be secured and therefore further accurate and minute image-forming apparatus can be realized.

What is claimed is:

1. An electron-emitting apparatus, comprising:

a substrate;

an electron-emitting device comprising a layer structure having: a first electroconductive member provided on a surface of said substrate; an insulation layer provided on said first electroconductive member; and a second electroconductive member provided on said insulation layer;

an anode electrode provided apart from the surface of said substrate;

first voltage application means for applying potential, higher than potential applied to said first electroconductive member, to said second electroconductive member; and second voltage application means for applying potential, higher than potential applied to said second electroconductive member, to said anode electrode, wherein $$T1 < A \times \exp\left[B \times (Vf - \phi wk)/(Vf)\right]$$

$$A = -0.50 + 0.56 \times \log(T3),\ B = 8.7$$

where:

on an end plane of said insulation layer placed substantially parallel to the surface of said substrate, an end portion of said first electroconductive member and an end portion of said second electroconductive member are set opposite each other with a space between;

in a direction of the end portion of said first electroconductive member and the end portion of said second electroconductive member set opposite each other, said second electroconductive member is T1 [nm] long;

said first electroconductive member extending from a surface of said first electroconductive member substantially parallel to the surface of said substrate toward the direction in which the end portion of said first electroconductive member and the end portion of said second electroconductive member are set opposite each other is T3 [nm] long;

a work function of said second electroconductive member is $\phi$wk [eV];

a voltage applied between said first electroconductive member and said second electroconductive member is Vf [V].

2. The apparatus according to claim 1, wherein said T1 is equal to or smaller than (A×exp [B×(Vf−$\phi$wk)/Vf)])/2.

3. The apparatus according to claim 1 or 2, wherein said T1 is equal to or larger than 10 nm.

4. The apparatus according to claim 1 or 2, wherein an angle made between the end plane of the insulation layer in the direction substantially parallel to the surface of said substrate and the surface of said substrate is equal to larger than 45° and equal to or smaller than 100°.

5. The apparatus according to claim 1 or 2, wherein an angle made between the end plane of the insulation layer in the direction substantially parallel to the surface of said substrate and the surface of said substrate is 90°±10°.

6. The apparatus according to claim 1 or 2, wherein:

said anode electrode is positioned away by H from the surface of said substrate;

a difference between the potential applied to said first electroconductive member and the potential applied to said anode electrode is Va [V]; and when said second electroconductive member is L1 long in a direction substantially parallel to the surface of said substrate, and $$\pi = 3.14,$$

said L1 is larger than 15 times a feature distance Xs defined by H×Vf/($\pi$×Va).

7. An image-forming apparatus, comprising:

(A) a first substrate provided with a plurality of electron-emitting devices;

(B) a second substrate having an anode electrode and an image-forming member;

(C) first voltage application means for applying a voltage to the electron-emitting device; and (D) second voltage application means for applying a voltage to the anode electrode, wherein:

said electron-emitting device comprises a layer structure having: a first electroconductive member provided on a surface of said substrate; an insulation layer provided on said first electroconductive member; and a second electroconductive member provided on the insulation layer;

first voltage application means applies potential, higher than potential applied to said first electroconductive member, to said second electroconductive member;

second voltage application means applies potential, higher than potential applied to the second electroconductive member, to the anode electrode;

$$T1 < A \times \exp\left[B \times (Vf - \phi wk)/(Vf)\right]$$

$$A = -0.50 + 0.56 \times \log(T3),\ B = 8.7$$

where:

on an end plane of the insulation layer placed substantially parallel to the surface of said substrate, the end portion of said first electroconductive member and the end portion of said second electroconductive member are set opposite each other with a space between;

in a direction of the end portion of said first electroconductive member and the end portion of said second electroconductive member set opposite each other, said second electroconductive member is T1 [nm] long;

said first electroconductive member extending from the surface of said first electroconductive member substantially parallel to the surface of said substrate toward the direction in which the end portion of said first electroconductive member and the end portion of said second electroconductive member are set opposite each other is T3 [nm] long;

the work function of said second electroconductive member is $\phi wk$ [eV];

the voltage applied between said first electroconductive member and said second electroconductive member is Vf [V].

8. The apparatus according to claim 7, wherein said T1 is equal to or smaller than $(A \times \exp[B \times (Vf - \phi wk)/Vf])/2$.

9. The apparatus according to claim 7 or 8, wherein said T1 is equal to or larger than 10 nm.

10. The apparatus according to claim 7 or 8, wherein an angle made between the end plane of the insulation layer in the direction substantially parallel to the surface of said substrate and the surface of said substrate is equal to or larger than 45° and equal to or smaller than 100°.

11. The apparatus according to claim 7 or 8, wherein an angle made between the end plane of the insulation layer in the direction substantially parallel to the surface of said substrate and the surface of said substrate is 90°±10°.

12. The apparatus according to claim 7 or 8, wherein:

said anode electrode is positioned away by H from the surface of said substrate;

a difference between the potential applied to said first electroconductive member and the potential applied to said anode electrode is Va [V];

when said second electroconductive member is L1 long in a direction substantially parallel to the surface of said substrate, and $$\pi = 3.14,$$

said L1 is larger than 15 times a feature distance Xs defined by $H \times Vf/(\pi \times Va)$.

* * * * *

UNITED STATES PATENT AND TRADEMARK OFFICE

CERTIFICATE OF CORRECTION

PATENT NO. : 6,384,542 B2
DATED : May 7, 2002
INVENTOR(S) : Takeo Tsukamoto

It is certified that error appears in the above-identified patent and that said Letters Patent is hereby corrected as shown below:

Column 6,
Line 9, “past” should read -- passed --.
Line 21, “occurrence” should read -- occurrences --.
Line 28, “denotes” should read -- denote --.
Line 34, “inbetween” should read -- in between --.

Column 7,
Line 24, “inbetween.” should read -- in between --.
Line 29, “in” should be deleted.
Line 40, “inbetween.” should read -- in between. --.
Line 50, “angel” should read -- angle --.

Column 9,
Line 1, “Aportion” should read -- portion --.
Line 49, “does” should read -- do --.
Line 66, “horizontalfs” should read -- horizontal --.

Column 10,
Line 10, “doe” should read -- do --.
Line 20, “extraporated” should read -- extrapolated --.
Line 56, “filed” should read -- field --.

Column 11,
Line 9, “ev),” should read -- eV), --.
Line 16, “lead” should read -- lead to --.
Line 47, “is” should read -- are --.

Column 12,
Line 13, “become small” should read -- becomes small so as --.
Line 22, “trajectoies” should read -- trajectories --.
Lines 31 and 57, “does” should read -- do --.
Line 35, “cause its trajectoy” should read -- causes its trajectory --.
Line 54, “number” should read -- frequency --.

Column 13,
Line 1, “resistant” should read -- resistance --.
Line 42, “this” should read -- these --.

UNITED STATES PATENT AND TRADEMARK OFFICE

CERTIFICATE OF CORRECTION

PATENT NO. : 6,384,542 B2
DATED : May 7, 2002
INVENTOR(S) : Takeo Tsukamoto

It is certified that error appears in the above-identified patent and that said Letters Patent is hereby corrected as shown below:

Column 14,
Line 18, “does” should read -- do --.
Line 45, “the both of” should read -- both the --.
Line 60, “trajectoies” should read -- trajectories --.

Column 15,
Line 8, “embodiment” should read -- embodiments --.
Line 9, “method.” should read -- methods. --.
Line 14, “showing” should read -- shown --.
Lines 53 and 58, “spattering” should read -- sputtering --.

Column 16,
Line 20, “spattering” should read -- sputtering --.
Line 61, “narrow” should read -- narrower --.

Column 18,
Line 8, “show” should read -- shown --.
Line 49, “arrangement” should read -- arrangements --; and “device” should read -- devices --.
Line 53, “each” should read -- to each --.
Line 57, “upper” should read -- above --.

Column 20,
Line 21, “flit” should read -- frit --.
Line 26, “late” should read -- plate --; and “162” should read -- frame 162 --.
Line 48, “with” should be deleted.

Column 22,
Line 5, “portions” should read -- portion --.
Line 47, “device” should read -- devices --.

Column 23,
Line 18, “both” should read -- either --.
Line 19, “of digital signal system and” should read -- a digital signal system or an --.

Column 25,
Lines 22 and 23, “resistant” should read -- resistance --.
Line 25, “both electrodes” should read -- two electrodes --.

UNITED STATES PATENT AND TRADEMARK OFFICE

CERTIFICATE OF CORRECTION

PATENT NO. : 6,384,542 B2
DATED : May 7, 2002
INVENTOR(S) : Takeo Tsukamoto

It is certified that error appears in the above-identified patent and that said Letters Patent is hereby corrected as shown below:

Column 26,
Line 1, “was” should be deleted.
Line 5, “is” should be deleted.

Column 27,
Line 63, “was” should be deleted.
Line 67, “is” should be deleted.

Column 28,
Line 54, “upper” should read -- above --.
Line 60, “was” should be deleted.

Column 30,
Lines 1 and 3, “resistant” should read -- resistance --.
Line 14, “was” should be deleted.
Line 20, “is” should be deleted.
Line 50, close up right margin.
Line 52, “that” should be deleted.

Column 31,
Line 25, “get” should read -- gets --.
Line 44, “loose” should read -- lose --.
Line 60, “of” should be deleted.

Column 32,
Line 1, “trajectoies” should read -- trajectories --.

Column 33,
Line 23, “flit” should read -- frit --.
Line 42, “party” should read -- part --.

Column 36,
Line 30, “in sufficient” should read -- insufficient --.

Column 38,
Lines 22 and 24, “resistant” should read -- resistance --.

UNITED STATES PATENT AND TRADEMARK OFFICE

CERTIFICATE OF CORRECTION

PATENT NO. : 6,384,542 B2
DATED : May 7, 2002
INVENTOR(S) : Takeo Tsukamoto

It is certified that error appears in the above-identified patent and that said Letters Patent is hereby corrected as shown below:

Column 39,
Lines 10, 32, 37 and 41, “resistant” should read -- resistance --.
Line 31, “.a” should read -- a --.

Signed and Sealed this

Seventeenth Day of June, 2003

JAMES E. ROGAN
*Director of the United States Patent and Trademark Office*